US010457045B2

(12) United States Patent
Wang et al.

(10) Patent No.: US 10,457,045 B2
(45) **Date of Patent: *Oct. 29, 2019**

(54) LIQUID EJECTION APPARATUS HAVING PIEZOELECTRIC ELEMENTS

(71) Applicant: BROTHER KOGYO KABUSHIKI KAISHA, Nagoya-shi, Aichi-ken (JP)

(72) Inventors: Rui Wang, Nagoya (JP); Yasuo Kato, Aichi-ken (JP); Toru Kakiuchi, Aichi-ken (JP); Yuichi Ito, Mie-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/012,165

(22) Filed: Jun. 19, 2018

(65) Prior Publication Data

US 2018/0297364 A1 Oct. 18, 2018

Related U.S. Application Data

(63) Continuation of application No. 15/470,478, filed on Mar. 27, 2017, now Pat. No. 10,016,976.

(30) Foreign Application Priority Data

Jun. 30, 2016 (JP) ..... 2016-129782

(51) Int. Cl.
*B41J 2/14* (2006.01)
*B41J 2/045* (2006.01)
*B41J 2/16* (2006.01)

(52) U.S. Cl.
CPC ..... *B41J 2/14233* (2013.01); *B41J 2/04581* (2013.01); *B41J 2/161* (2013.01);
(Continued)

(58) Field of Classification Search
CPC .... B41J 2/14233; B41J 2/04581; B41J 2/161; B41J 2/14072; B41J 2002/14241; B41J 2002/14491
See application file for complete search history.

(56) References Cited

U.S. PATENT DOCUMENTS 10,016,976 B2 * 7/2018 Wang et al. ..... B41J 2/14233
2014/0132677 A1 * 5/2014 Kondo ..... B41J 2/14201

FOREIGN PATENT DOCUMENTS

JP 2003-080703 A 3/2003
JP 2015-150793 A 8/2015
(Continued)

*Primary Examiner* — Juanita D Jackson
(74) *Attorney, Agent, or Firm* — Merchant & Gould P.C.

(57) ABSTRACT

A liquid ejection apparatus, including: first piezoelectric elements arranged on an element-disposed surface in a first direction; a protective cover covering the first piezoelectric elements and including a top wall portion and two side wall portions connected thereto; first wires drawn respectively from the first piezoelectric elements to an outside of the protective cover in a second direction parallel to the element-disposed surface and orthogonal to the first direction and extending on an outer surface of the top wall portion via an outer surface of a corresponding side wall portion; first terminals disposed on the outer surface of the top wall portion and connected respectively to the first wires; and a driver electrically connected to the first terminals, wherein a distance in the first direction between any adjacent two of the first wires on an outer surface of the protective cover is larger than that on the element-disposed surface.

14 Claims, 20 Drawing Sheets

(52) U.S. Cl.
CPC .. *B41J 2/14201* (2013.01); *B41J 2002/14241* (2013.01); *B41J 2002/14419* (2013.01); *B41J 2002/14491* (2013.01)

(56) References Cited

FOREIGN PATENT DOCUMENTS

| | | | |
|---|---|---|---|
| JP | 2016-078272 | A | 5/2016 |
| JP | 2016078272 | A | 5/2016 |

* cited by examiner

LIQUID EJECTION APPARATUS HAVING PIEZOELECTRIC ELEMENTS

CROSS REFERENCE TO RELATED APPLICATION

The present application is a continuation of U.S. patent application Ser. No. 15/470,478, filed Mar. 27, 2017, which further claims priority from Japanese Patent Application No. 2016-129782, which was filed on Jun. 30, 2016, the disclosures of both of which are herein incorporated by reference in its entirety.

BACKGROUND

Technical Field

The present disclosure relates to a liquid ejection apparatus.

Description of Related Art

There has been known an ink-jet head, as a liquid ejection apparatus, included in a printer. The known ink-jet head includes a nozzle plate in which a plurality of nozzles are formed, a flow-passage defining member (flow-passage forming plate) in which are formed a plurality of pressure chambers communicating with the nozzles, and a plurality of piezoelectric elements provided on the flow-passage defining member so as to correspond to the respective pressure chambers. The flow-passage defining member is provided with a protective cover (sealing plate) that covers the piezoelectric elements.

Wires (lead electrodes) are connected to the respective piezoelectric elements. Each wire extends on an upper surface of the flow-passage defining member from the corresponding piezoelectric element to an outside of the protective cover and is drawn to an upper surface of the protective cover via a side surface of the protective cover. A flexible board, as a wiring member, is electrically connected to ends of the respective wires disposed on the upper surface of the protective cover. In the known ink-jet head, a distance between any adjacent two wire portions disposed on the upper surface of the flow-passage defining member (i.e., first lead electrodes) is the same as a distance between any adjacent two wire portions disposed on the outer surface of the protective cover (i.e., second lead electrodes). That is, the wires are disposed at the same pitch on both of the upper surface of the flow-passage defining member and the outer surface of the protective cover.

SUMMARY

In view of the recent trend of downsizing of the head by disposing the nozzles at a higher density, it is demanded that the piezoelectric elements are disposed at a smaller pitch. In the known head, the wires respectively drawn from the piezoelectric elements are disposed at the same pitch on both of the upper surface of the flow-passage defining member and the outer surface of the protective cover. In this configuration, in an instance where the pitch of the piezoelectric elements is made small, the pitch of the wires on the protective cover needs to be accordingly made small. This inevitably requires highly precise and fine formation of the wires also on the protective cover, undesirably pushing up the production cost. Further, in an instance where the pitch of the wires on the protective cover is made small, a pitch of terminals and wires of the wiring member (flexible board) to be electrically connected to the wires of the protective cover also needs to be made small, resulting in an increased cost of the wiring member.

An aspect of the disclosure relates to a liquid ejection apparatus in which wires connected to piezoelectric elements are drawn onto an outer surface of a protective cover, wherein highly precise and fine formation of the wires on the outer surface of the protective cover is not required so as to reduce a wiring cost.

One aspect of the disclosure provides a liquid ejection apparatus, including: a plurality of first piezoelectric elements disposed on an element-disposed surface of a flow-passage defining member so as to be arranged in a first direction; a protective cover disposed on the element-disposed surface so as to cover the first piezoelectric elements and including a top wall portion opposed to the first piezoelectric elements and two side wall portions connected respectively to opposite end portions of the top wall portion in a second direction parallel to the element-disposed surface and orthogonal to the first direction; a plurality of first wires drawn respectively from first piezoelectric elements to an outside of the protective cover in the second direction and extending on an outer surface of the top wall portion of the protective cover via an outer surface of a corresponding one of the side wall portions; a plurality of first terminals disposed on the outer surface of the top wall portion and connected respectively to the first wires; and a driver electrically connected to the first terminals, wherein a distance in the first direction between any adjacent two of the first wires on an outer surface of the protective cover is larger than that on the element-disposed surface.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
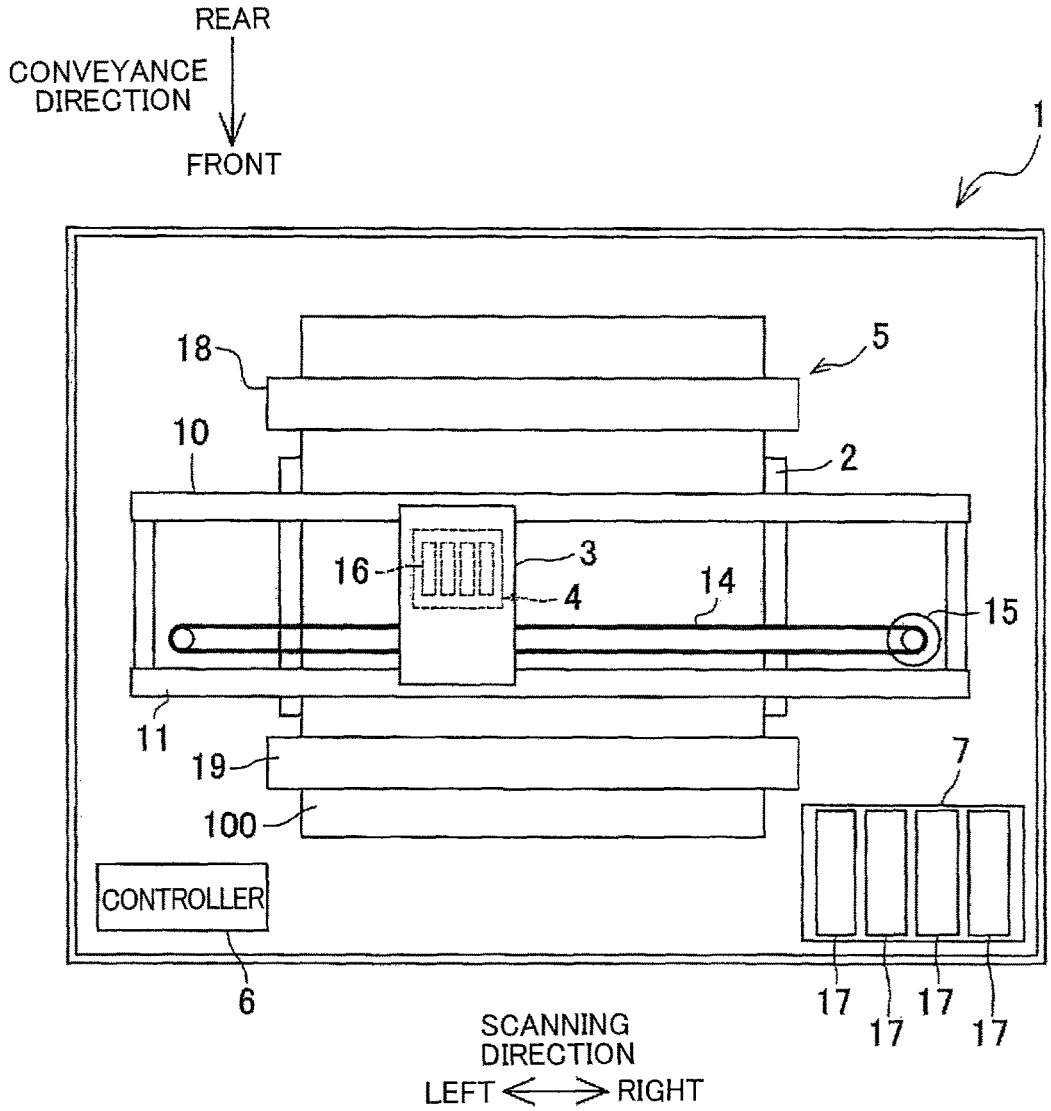
FIG. 1 is a plan view schematically showing a printer according to one embodiment.

There will be described one embodiment of the disclosure. Referring first to FIG. 1, an ink-jet printer 1 will be explained. In FIG. 1, a direction in which a recording sheet 100 is conveyed is defined as a front-rear direction of the printer 1. A width direction of the recording sheet 100 is defined as a right-left direction of the printer 1. A direction perpendicular to the sheet plane of FIG. 1, which is orthogonal to both of the front-rear direction and the right-left direction, is defined as an up-down direction of the printer 1.

Overall Structure of Printer

As shown in FIG. 1, the ink-jet printer 1 includes a platen 2, a carriage 3, an ink-jet head 4, a conveyor mechanism 5, and a controller 6.

The recording sheet 100 as a recording medium is placed on an upper surface of the platen 2. The carriage 3 is movable in a region in which the carriage 3 is opposed to the platen 2, so as to reciprocate in the right-left direction (hereinafter also referred to as "scanning direction" where appropriate) along two guide rails 10, 11. An endless belt 14 is connected to the carriage 3. When the endless belt 14 is driven by a carriage drive motor 15, the carriage 3 reciprocates in the scanning direction.

The ink-jet head 4 is mounted on the carriage 3 and is configured to move in the scanning direction with the carriage 3. The ink-jet head 4 includes four head units 16 arranged in the scanning direction. The four head units 16 are connected, through respective tubes (not shown), to a cartridge holder 7 that holds four ink cartridges 17 in which black ink, yellow ink, cyan ink, and magenta ink are respectively stored.

Each head unit 16 has a plurality of nozzles 36 (FIGS. 5 and 6) formed in its lower surface (corresponding to the back surface of the sheet of FIG. 1). Each head unit 16 ejects the ink supplied from a corresponding one of the ink cartridges 17 from the nozzles 36 to the recording sheet 100 on the platen 2. The head unit 16 will be later explained in detail.

The conveyor mechanism 5 includes two conveyance rollers 18, 19 disposed so as to sandwich the platen 2 therebetween in the front-rear direction. The conveyor mechanism 5 is configured such that the two conveyance rollers 18, 19 convey the recording sheet 100 placed on the platen 2 toward the front side, namely, in a sheet conveyance direction.

The controller 6 includes a read only memory (ROM), a random access memory (RAM), and an application specific integrated circuit (ASIC) including various control circuits. The controller 6 executes various processes such as a printing process on the recording sheet 100 by the ASIC according to programs stored in the ROM. In the printing process, for instance, the controller 6 controls the ink-jet head 4, the carriage drive motor 15, and other related components based on a print command input from an external device such as a personal computer (PC), such that an image or the like is printed on the recording sheet 100. Specifically, the controller 6 controls the printer 1 so as to alternately perform an ink ejecting operation in which the ink-jet head 4 ejects the ink while moving in the scanning direction with the carriage 3 and a conveying operation in which the recording sheet 100 is conveyed by the conveyance rollers 18, 19 in the sheet conveyance direction by a predetermined amount.

Detailed Structure of Head Unit

There will be next explained a structure of each head unit 16 of the ink-jet head 4. Because the four head units 16 are identical with each other in structure, one of the four head units 16 will be explained below.

As shown in FIGS. 2-7, the head unit 16 includes a first flow-passage defining member 21, a second flow-passage defining member 22, a nozzle plate 23, a piezoelectric actuator 24, a chip on film (COF) 25, a protective cover 26, and an ink supply member 27.

First Flow-Passage Defining Member, Second Flow-Passage Defining Member, and Nozzle Plate The first flow-passage defining member 21, the second flow-passage defining member 22, and the nozzle plate 23 will be explained. The three members have a rectangular shape in plan view. The first flow-passage defining member 21, and the second flow-passage defining member 22, and the nozzle plate 23 are stacked in the up-down direction in this order from the top. While the material for the first flow-passage defining member 21 is not limited, it is preferable to use a silicon single crystal plate in an instance where piezoelectric elements 41 (which will be described) are formed by deposition. The second flow-passage defining member 22 and the nozzle plate 23 may be formed of metal or resin other than the silicon single crystal plate. In terms of prevention of warpage and cracking due to heat, the second flow-passage defining member 22 and the nozzle plate 23 are preferably formed by the silicon single crystal plate, like the first flow-passage defining member 21.

Figure 5:
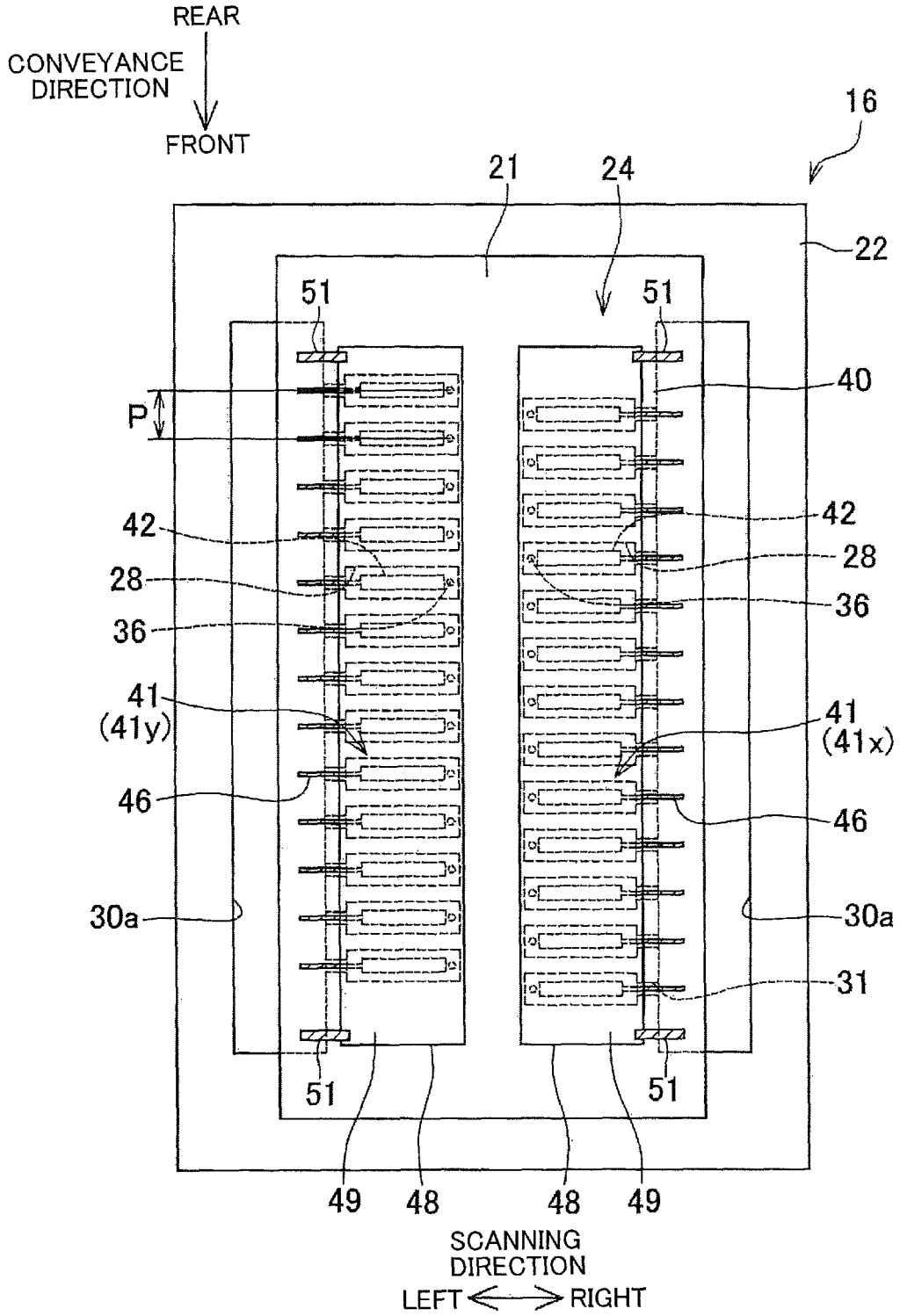
FIG. 5 is a plan view of the head unit 16 in which the ink supply member and the protective cover are not illustrated.
Figure 6:
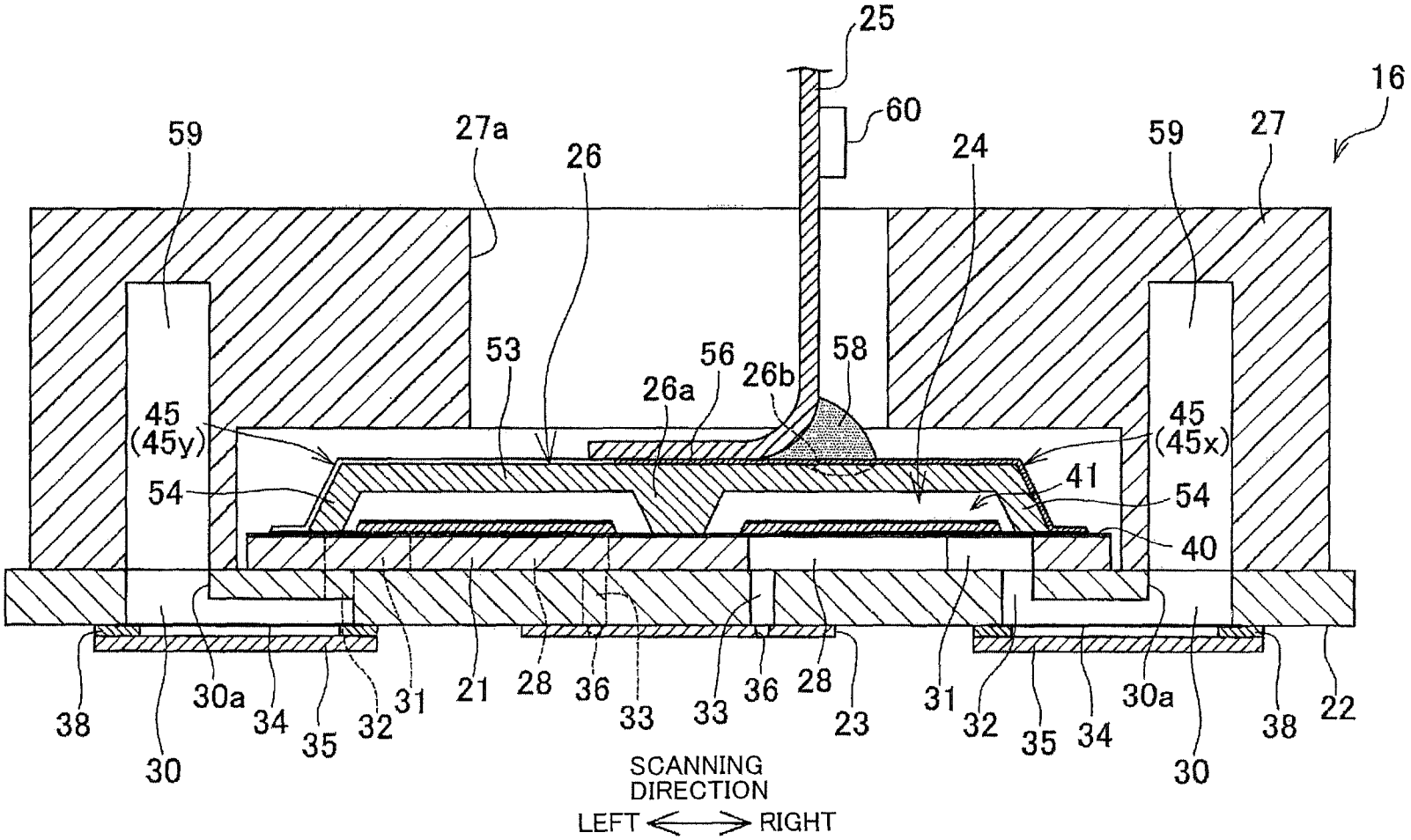
FIG. 6 is a cross-sectional view taken along line VI-VI in FIG. 2.

As shown in FIGS. 5 and 6, a plurality of pressure chambers 28 are formed in the first flow-passage defining member 21 along the horizontal plane. Each pressure chamber 28 has a rectangular shape, in plan view, which is elongate in the scanning direction. The pressure chambers 28 are arranged in the sheet conveyance direction and form two pressure-chamber rows arranged in the scanning direction. The position of the pressure chamber 28 in the sheet conveyance direction differs between the two pressure-chamber rows. Specifically, in an instance where a distance between adjacent two of the pressure chambers 28 in each of the two pressure-chamber rows is defined as "P", the position of the pressure chamber 28 in the sheet conveyance direction of one of the two pressure-chamber rows is shifted by a distance corresponding to P/2 with respect to the position of the pressure chamber 28 in the sheet conveyance direction of the other of the two pressure-chamber rows. An orifice passage 31 is formed outward of each pressure chamber 28 in the right-left direction, so as to communicate with the corresponding pressure chamber 28.

Figure 7:
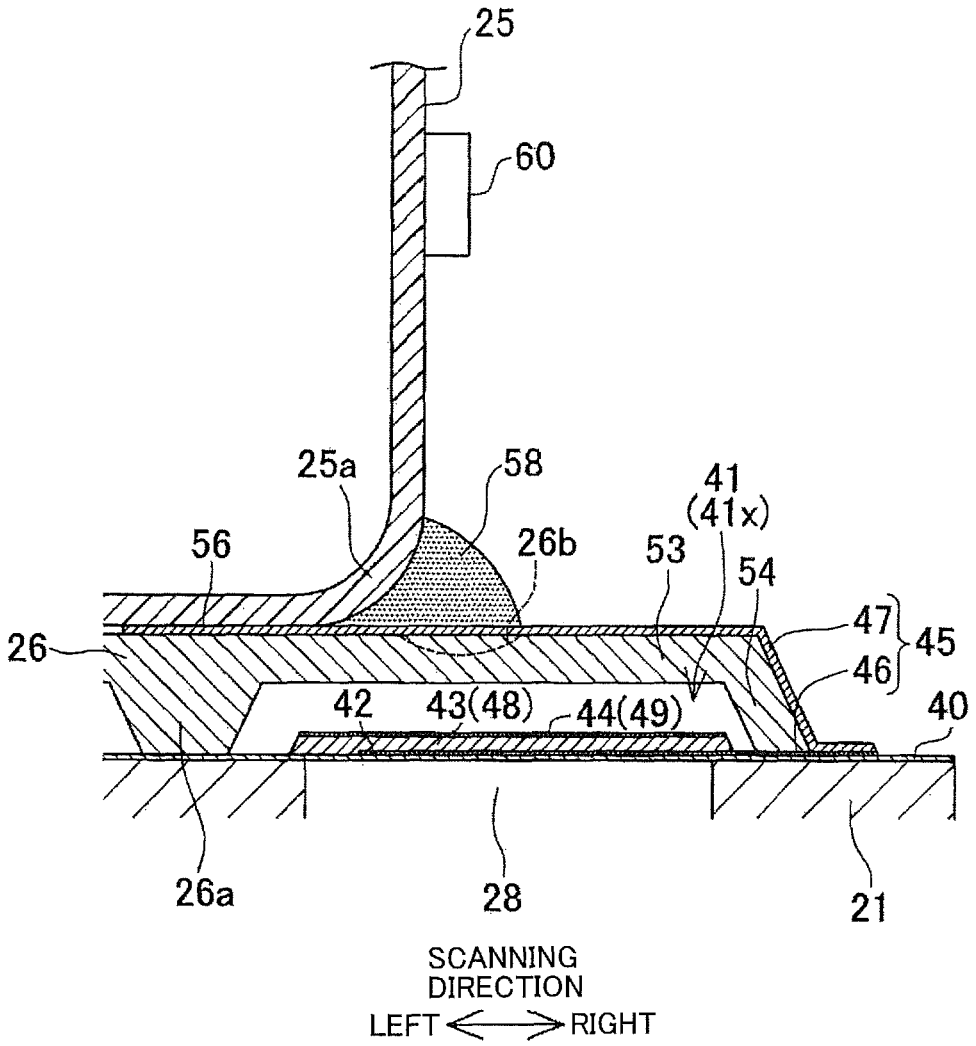
FIG. 7 is an enlarged view of a part in FIG. 6.

As shown in FIGS. 6 and 7, there is formed, on an upper surface of the first flow-passage defining member 21, an oscillating film 40 that constitutes a part of the piezoelectric actuator 24. The oscillating film 40 coves the pressure chambers 28 from above. For instance, the oscillating film 40 is a silicon dioxide membrane formed by oxidizing the surface of silicon single crystal plate that constitutes the first flow-passage defining member 21.

Figure 3:
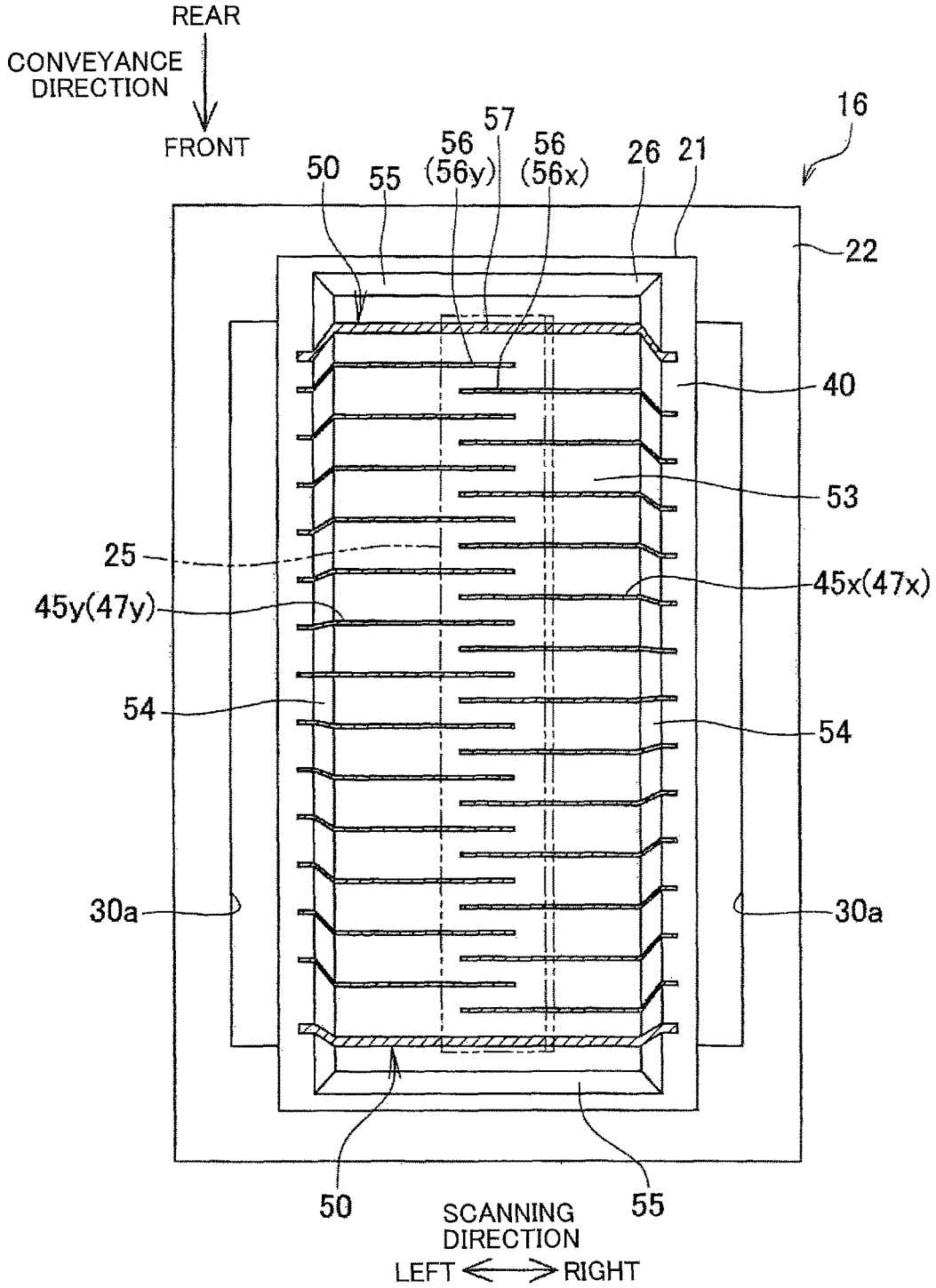
FIG. 3 is a plan view of the head unit 16 in which an ink supply member is not illustrated.

The second flow-passage defining member 22 is disposed under the first flow-passage defining member 21. As shown in FIGS. 3, 5, and 6, the second flow-passage defining member 22 has a size, in plan view, somewhat larger than the first low-passage defining member 21, and an entire outer peripheral portion of the second low-passage defining member 22 protrudes outward from the first flow-passage defining member 21.

As shown in FIGS. 5 and 6, two manifolds 30 respectively corresponding to the two pressure-chamber rows and extending in the sheet conveyance direction are formed at one and the other of right and left protruded portions of the second flow-passage defining member 22. That is, openings 30*a* of the respective manifolds 30 are not covered by the first flow-passage defining member 21 and are exposed to the exterior. The ink supply member 27 is connected to the two manifolds 30. The ink stored in one ink cartridge 17 is supplied to the two manifolds 30 via the ink supply member 27. In the present embodiment, the ink in the same color is supplied to the two manifolds 30.

Communication passages 32 are formed in the second flow-passage defining member 22 so as to communicate with inner ends of the respective manifolds 30 in the right-left direction. Each pressure chamber 28 is held in communication with the corresponding manifold 30 via the corresponding orifice passage 31 and communication passage 32. Communication passages 33 are formed in the second flow-passage defining member 22 for permitting communication between each pressure chamber 28 and a corresponding nozzle 36 formed in the nozzle plate 23.

Flexible damper films 34 are bonded to a lower surface of the second flow-passage defining member 22 so as to cover the respective manifolds 30. Each damper film 34 is for damping a variation in the pressure of the ink in the corresponding manifold 30. Protective plates 35 are provided under the respective damper films 34 via respective metal spacers 3 each shaped like a frame. Thus, the damper films 34 are protected by the protective plates 35.

A plurality of nozzles 36 corresponding to the plurality of pressure chambers 28 are formed in the nozzle plate 23. Each nozzle 36 is held in communication with the corresponding pressure chamber 28 of the first flow-passage defining member 21 via the corresponding communication passage 33 formed in the second flow-passage defining member 22. As shown in FIG. 5, the nozzles 36 are arranged in two rows so as to correspond to the two rows of the pressure chambers 28. Like the pressure chambers 28, the position in the sheet conveyance direction of the nozzle 36 in one row is shifted by P/2 relative to the position in the sheet conveyance direction of the nozzle 36 in the other row.

Piezoelectric Actuator

The piezoelectric actuator 24 will be next explained. As shown in FIGS. 5-7, the piezoelectric actuator 24 is disposed above the first flow-passage defining member 21. The piezoelectric actuator 24 includes the oscillating film 40 and a plurality of piezoelectric elements 41 provided on the oscillating film 40.

As described above, the oscillating film 40 is formed on the upper surface of the first flow-passage defining member 21 and cover the plurality of pressure chambers 28. The oscillating film 40 has a thickness of 1.0-1.5 μm, for instance. The piezoelectric elements 41 are provided at positions of the upper surface of the oscillating film 40 that correspond to the respective pressure chambers 28. Like the pressure chambers 28, the piezoelectric elements 41 are arranged in the front-rear direction so as to form two piezoelectric-element rows, namely, a right-side row and a left-side row. In the following explanation, the piezoelectric elements 41 in the right-side row will be referred to as "piezoelectric elements 41*x*" and the piezoelectric elements 41 in the left-side row will be referred to as "piezoelectric elements 41*y*".

Each piezoelectric element 41 will be explained. Each piezoelectric element 41 includes a lower electrode 42 disposed on the oscillating film 40, a piezoelectric film 43 disposed on the lower electrode 42, and an upper electrode 44 disposed on the piezoelectric film 43.

The lower electrode 42 is disposed on the upper surface of the oscillating film 40 so as to overlap the pressure chamber 28. The lower electrode 42 is an individual electrode to which a drive signal is supplied from a driver IC 60. The lower electrode 42 is formed of platinum (Pt) and has a thickness of 0.1-0.3 μm, for instance.

Figure 4:
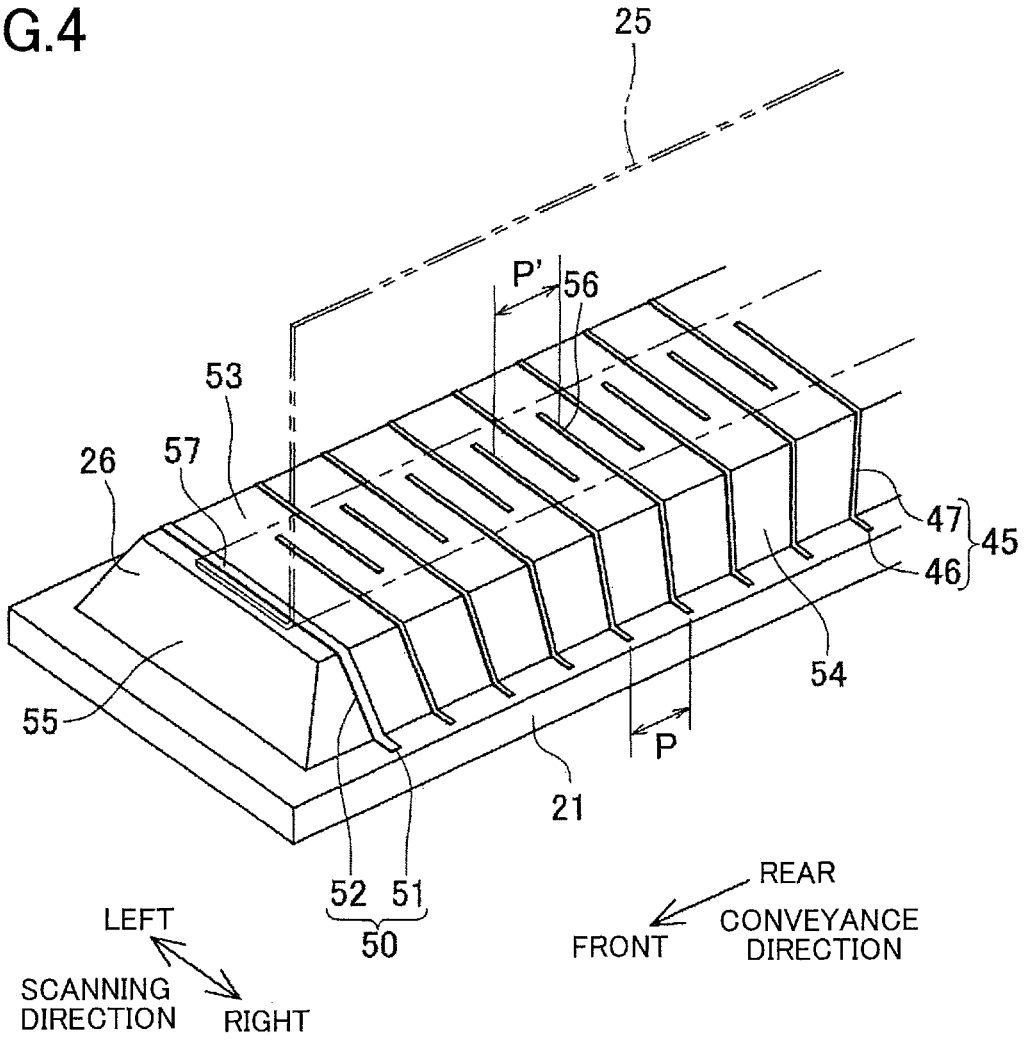
FIG. 4 is a perspective view of a first flow-passage defining member and a protective cover of the head unit 16.

The lower electrode 42 is connected to the COF 25 via a drive wire 45 (45*x*, 45*y*). When the drive signal is applied to the lower electrode 42 from the driver IC 60 provided on the COF 25, the potential of the lower electrode 42 is switched between a predetermined drive potential and a ground potential. As shown in FIGS. 4 and 7, the drive wire 45 includes a lower wire 46 provided on the upper surface of the oscillating film 40 and an upper wire 47 provided on an outer surface of the protective cover 26. The lower wire 46 provided on the oscillating film 40 is first explained, and the upper wire 47 provided on the protective cover 26 is later explained.

The lower wire 46 is drawn out from the lower electrode 42 in the scanning direction on the upper surface of the oscillating film 40. In the right-side piezoelectric element 41*x*, the lower wire 46 drawn rightward from the lower electrode 42 extends outward of a right side wall portion 54 of the protective cover 26, and one end of the lower wire 46 is not covered by the protective cover 26. In the left-side piezoelectric element 41*y*, the lower wire 46 drawn leftward from the lower electrode 42 extends outward of a left side wall portion 54 of the protective cover 26, and one end of the lower wire 46 is not covered by the protective cover 26. The plurality of lower wires 46 are arranged in the front-rear direction at the same pitch as the pitch P of the pressure chambers 28 (i.e., the pitch of the piezoelectric elements 41). Each lower wire 46 is conductive, at the one end thereof not covered by the protective cover 26, with the upper wire 47 provided on the outer surface of the protective cover 26.

The material for the lower wire 46 is not limited. By using the same material as the lower electrode 42, e.g., platinum, the lower electrode 42 and the lower wire 46 are formed at one time in the same process (deposition and etching).

The piezoelectric film 43 is formed of a piezoelectric material such as lead zirconate titanate (PZT). The piezoelectric film 43 has a thickness of 1.0-2.0 μm, for instance. As shown in FIG. 5, in the present embodiment, the piezoelectric films 43 of the right-side piezoelectric elements 41*x* are connected to one another, and the piezoelectric films 43 of the left-side piezoelectric elements 41*y* are connected to one another. In other words, there are formed, on the oscillating film 40, two piezoelectric members 48, i.e., a piezoelectric member 48 that covers the right-side pressure chambers 28 and a piezoelectric member 48 that covers the left-side pressure chambers 28.

The upper electrode 44 is disposed on an upper surface of the piezoelectric film 43. The upper electrode 44 is formed of iridium and has a thickness of 0.1 μm, for instance. The upper electrodes 44 respectively corresponding to the pressure chambers 28 are connected to one another on the upper surface of each piezoelectric member 48, thereby constituting a common electrode 49 that covers a substantially entire upper surface of the piezoelectric member 48.

Each common electrode 49 is connected to a ground of the COF 25 via ground wires 50 and is always kept at the ground potential. Like the drive wire 45, each ground wire 50 includes a lower wire 51 provided on the upper surface of the oscillating film 40 and an upper wire 52 provided on the outer surface of the protective cover 26, as shown in FIGS. 4 and 5. The two lower wires 51 are drawn respectively from front and rear ends of the common electrode 49 corresponding to one piezoelectric member 48 and extend outward in the scanning direction on the upper surface of the oscillating film 40. Each lower wire 51 extends outward of the protective cover 26, and one end of the lower wire 51 is not covered by the protective cover 26. The lower wire 51 is conductive, at the one end thereof not covered by the protective cover 26, with the upper wire 52 provided on the outer surface of the protective cover 26.

There will be next explained an operation of each piezoelectric element 41 when the drive signal is supplied to the lower electrode 42 from the driver IC 60. In a state in which the drive signal is not supplied, the potential of the lower electrode 42 is equal to the ground potential which is the same potential of the upper electrode 44. When the drive signal is supplied to one lower electrode 42 and the drive potential is applied to the lower electrode 42, there is generated a potential difference between the lower electrode 42 and the upper electrode 44, and an electric field parallel to the thickness direction of the piezoelectric film 43 acts on the piezoelectric film 43. The electric field causes the piezoelectric film 43 to expand in the thickness direction and to contract in the surface direction, so that the oscillating film 40 covering the pressure chamber 28 is deflected so as to protrude toward the pressure chamber 28. Consequently, the volume of the pressure chamber 28 is decreased and pressure waves are generated in the pressure chamber 28, so that ink droplets are ejected from the nozzle 36 communicating with the pressure chamber 28.

Protective Cover

As shown in FIGS. 3, 4, and 6-8, the protective cover 26 is disposed above the oscillating film 40 of the first flow-passage defining member 21, so as to cover the plurality of piezoelectric elements 41. The protective cover 26 includes a horizontal top wall portion 53 that is opposed to the piezoelectric elements 41, two side wall portions 54 connected to one and the other of opposite ends of the top wall portion 53 in the right-left direction, and two end wall portions 55 connected to one and the other of opposite ends of the top wall portion 53 in the front-rear direction. The right-left direction in which the two side wall portions 54 are arranged is a direction parallel to the surface of the oscillating film 40 and orthogonal to the arrangement direction of the piezoelectric elements 41. Each of the side wall portions 54, 55 is inclined inward with respect to the up-down direction orthogonal to the surface of the oscillating film 40. In other words, each of the side wall portions 54, 55 is inclined inward such that an upper part of each of the side wall portions 54, 55 that is remote from the oscillating film 40 is located nearer to a center line of the protective cover 26 extending in the front-rear direction than a lower part of each of the side wall portions 54, 55. The material for the protective cover 26 is not limited, but the protective cover 26 may be formed of silicon or silicone, for instance.

A partition wall portion **26*a* is formed in the protective cover 26 so as to extend in the front-rear direction. The partition wall portion 26*a* is connected at its upper end to a central portion of the top wall portion 53 in the right-left direction. The partition wall portion 26*a* divides an inner space of the protective cover 26 into two spaces in which the piezoelectric elements 41 in the right row and the piezoelectric elements 41** in the left row are respectively accommodated.

On the outer surface of the protective cover 26, the upper wires 47 of the drive wires 45 and the upper wires 52 of the ground wires 50 are formed. The material for the upper wires 47, 52 is not limited, but the upper wires 47, 52 may be formed of gold (Au), for instance. Unlike the lower wires 46 covered by the protective cover 26, the upper wires 47 are exposed. To prevent a break of the upper wires 47, 52, it is preferable that the upper wires 47, 52 have a thickness (e.g., 1 μm) larger than the lower wires 46, 51 formed on the oscillating film 40.

As shown in FIGS. 3 and 4, the upper wires 47 corresponding to the right-side piezoelectric elements **41*x* and the two upper wires 52 are formed in a region of the protective cover 26 extending from the outer surface of the right side wall portion 54 to the upper surface of the top wall portion 53. Likewise, the upper wires 47 corresponding to the left-side piezoelectric elements 41*y* and the two upper wires 52 are formed in a region of the protective cover 26 extending from the outer surface of the left side wall portion 54 to the upper surface of the top wall portion 53**.

The upper wires 47 of the drive wires 45 are disposed so as to be spaced apart from one another in the front-rear direction on the right side and the left side of the protective cover 26. The upper wires 52 of the ground wires 50 are disposed such that the upper wires 47 are interposed therebetween in the front-rear direction. A lower end of the upper wire 47 of the drive wire 45 is conductive, on the upper surface of the oscillating film 40, with the lower wire 46 drawn from the lower electrode 42 of the piezoelectric element 41 to the outside of the protective cover 26. Likewise, the upper wire 52 of the ground wire 50 is conductive, on the upper surface of the oscillating film 40, with the lower wire 51 drawn from the upper electrode 44 (the common electrode 49) of the piezoelectric element 41 to the outside of the protective cover 26.

Drive terminals 56 connected to the respective upper wires 47 are arranged in the front-rear direction at a central portion of the upper surface of the top wall portion 53. Specifically, drive terminals **56*x* respectively connected to the ends of the upper wires 47 of the right-side drive wires 45*x* and drive terminals 56*y* respectively connected the ends of the upper wires 47 of the left-side drive wires 45*y* are alternately arranged in the front-rear direction. That is, the positions of the right-side drive terminals 56*x* in the right-left direction and the positions of the left-side drive terminals 56*y* in the right-left direction coincide with one another. With this configuration, a region in which the drive terminals 56 are disposed is reduced in the right-left direction, and the size of the protective cover 26 in the right-left direction is accordingly reduced. Further, when the region in which the drive terminals 56 are disposed is reduced in the right-left direction, a bonding region of the COF25 is accordingly reduced. In this instance, even if the posture of the COF25 is slightly inclined when bonded to the protective cover 26, the drive terminals 56 of the protective cover 26 and terminals of the COF 25 are easily brought into contact with one another. Two ground terminals 57 are disposed such that the drive terminals 56 are interposed therebetween in the front-rear direction. To one ground terminal 57, the upper wire 52 extending from the right side and the upper wire 52** extending from the left side are connected.

The protective cover 26 covers the plurality of piezoelectric elements 41. Thus, the protective cover 26 is longer in the front-rear direction than an area of the upper surface of the oscillating film 40 in which the plurality of piezoelectric elements 41 are disposed. It is therefore possible to form the upper wires 47 at a large pitch on the outer surface of the protective cover 26. In the present embodiment, a distance in the front-rear direction between adjacent two drive wires 45 on the outer surface of the protective cover 26 (i.e., a distance between adjacent two upper wires 47) is larger than a distance in the front-rear direction between adjacent two drive wires 45 on the upper surface the oscillating film 40 (i.e., a distance between adjacent two lower wires 46).

Figure 8:
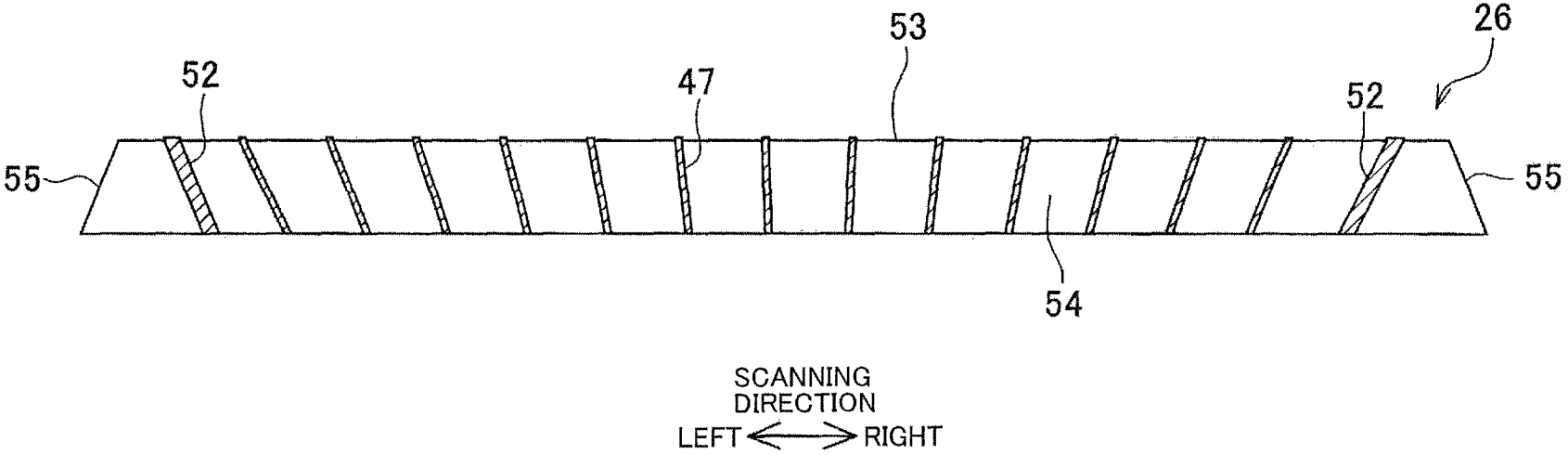
FIG. 8 is a side view of the protective cover.

Specifically, the upper wires 47 extend upward while spreading fanwise or radially on each of the right and left side wall portions 54, as shown in FIGS. 3, 4, and 8. The upper wires 47, a distance between adjacent two of which is increased on each side wall portion 54, extend in a direction parallel to the right-left direction on the upper surface of the top wall portion 53. With this configuration, the distance P' between adjacent two of the upper wires 47 formed on the outer surface of each side wall portion 54 and the upper surface of the top wall portion 53 is larger than the distance P of adjacent two of the lower wires 46 (i.e., the pitch of the piezoelectric elements 41) formed on the upper surface of the oscillating film 40. The distance between adjacent two of the upper wires 47 is larger than the distance P of adjacent two of the lower wires 46 at least in the vicinity of the drive terminals 56 or at least at a portion of each side wall portion 53, 54 near the top wall portion 53.

This configuration eliminates a need of highly precise and fine formation of the plurality of drive wires 45 on the outer surface of the protective cover 26, making it possible to reduce the production cost of the head unit 16. Further, by increasing the distance between adjacent two of the upper wires 47, the distance between adjacent two of the drive terminals 56 disposed on the upper surface of the top wall portion 53 can be increased, making it possible to increase a distance between adjacent terminals and wires of the COF 25.

The upper wires 47, 52 are formed on the outer surface of the protective cover 26 by the following method, for instance. Initially, a conductive film is formed by sputtering or the like over an entire surface of the protective cover 26. The conductive film is then patterned by etching so as to form the upper wires 47, 52. Here, it is more difficult to form wires by etching on an outer surface of a side wall portion that extends in the vertical direction than to form wires by etching on a horizontal surface, so that highly precise and fine formation of the wires is more difficult on the vertically extending side wall portion. In the present embodiment, the distance between adjacent two of the upper wires 47 is made larger on the outer surface of the protective cover 26, especially, on the side wall portion 54. That is, it is not necessary to form wires by etching with high precision on the outer surface of the side wall portion 54 (the inclined surface), simplifying formation of the upper wires 47 on the side wall portion 54.

It becomes more difficult to form wires on the outer surface of the side wall portion 54 as the surface direction of the side wall portion 54 when viewed from the front-rear direction becomes closer to the vertical direction. In the present embodiment, each side wall portion 54 is inclined inward with respect to the up-down direction, simplifying formation of the upper wires 47 on the side wall portion 54. The gentler the inclination angle of the side wall portion 54 with respect to the upper surface of the oscillating film 40, the easier the formation of the upper wires 47 on the side wall portion 54. For instance, the inclination angle of the side wall portion 54 is preferably 45 degrees or lower.

COF

As shown in FIGS. 4, 6, and 7, the COF 25 is bonded by a conductive adhesive to the central portion of the upper surface of the top wall portion 53 of the protective cover 26 in a state in which a distal portion of the COF 25 is bent. With this configuration, the plurality of drive terminals 56 and the two ground terminals 57 are electrically connected to the wires (not shown) of the COF 25. As shown in FIGS. 6 and 7, the protective cover 26 has the partition wall portion **26*a* under the central portion of the top wall portion 53. When the COF 25 is pressed onto and is bonded to the central portion of the top wall portion 53, the partition wall portion 26*a* receives a part of the pressing force, so as to reduce flection of the top wall portion 53. Thus, the COF 25 is bonded to the protective cover 26 in a state in which the terminals of the COF 25 are in contact with the terminals 56, 57 of the protective cover 26, resulting in an increased reliability of electrical connection of the COF 25**.

A bent portion **25*a* of the COF 25 is fixed to the protective cover 26 by a fixing portion 58 as one example of an anchorage. The structure of the fixing portion 58 is not limited. For instance, a liquid fixing agent composed of hardening resin is poured into a back side of the bent portion 25*a* and is subsequently hardened, whereby the fixing portion 58 is easily formed. The bent portion 25*a* of the COF 25 is fixed to the protective cover 26 by the fixing portion 58, so that the COF 25 is prevented from being separated from the protective cover 26**.

As shown in FIGS. 6 and 7, a recess **26*b* may be formed in the upper surface of the protective cover 26 in which the liquid fixing agent for forming the fixing portion 58 is applied. The recess 26*b* may have any shape. In terms of prevention of a break of the upper wires 47 formed on the outer surface of the protective cover 26, it is desirable that the recess 26*b* have a curved shape shown in FIGS. 6 and 7. The recess 26*b* is formed at a predetermined position of the upper surface of the protective cover 26, so that the liquid fixing agent is unlikely to flow out of the recess, and the fixing portion 58 can be formed at the intended position with high reliability. Further, the recess 26*b* is preferably formed away from the region of the upper surface of the protective cover 26 in which the drive terminals 56 are disposed. In an instance where the recess 26*b* is away from the drive terminals 56, the fixing portion 58 is also away from the drive terminals 56. Thus, when the COF 25 is bonded, the fixing portion 58 is prevented from being pressed and crushed. Further, the fixing portion 58 does not interfere with the COF 25 when the COF 25 is bonded to the protective cover 26**.

While not shown, one end of the COF 25 opposite to another end thereof near to the protective cover 26 is connected to the controller 6 (FIG. 1). The COF 25 is provided with the driver IC 60. The driver IC 60 is electrically connected to the controller 6 via wires (not shown) of the COF 25. The driver IC 60 is electrically connected also to the drive terminals 56 via wires of the COF 25. The driver IC 60 outputs, to the lower electrodes 42 connected to the drive terminals 56, drive signals based on control signals sent from the controller 6 and switches the potential of the lower electrodes 42 between the ground potential and the drive potential. The ground terminals 57 are electrically connected to the ground (not shown) of the COF 25. Thus, the upper electrodes 44 that constitute the common electrode 49 are held at the ground potential.

As described above, the distance between adjacent two of the upper wires 47 on the top wall portion 53 of the protective cover 26 is larger than the distance between adjacent to of the lower wires 46 on the oscillating film 40. Thus, the distance between adjacent two of the drive terminals 56 on the upper surface of the top wall portion 53 is accordingly large. This configuration makes it possible to increase the distance between adjacent terminals and wires of the COF 25, so as to eliminate a need to form wires on the COF 25 with high precision. Consequently, the production cost of the COF 25 is reduced. In the present embodiment, because the right-side drive terminals 56*x* and the left-side drive terminals 56*y* are alternately arranged in the front-rear direction, the distance between adjacent two of the drive terminals 56 on the top wall portion 53 is reduced. In the present embodiment, however, the distance between adjacent two of the drive wires 45 is increased on the protective cover 26, so that the distance between adjacent two of the drive terminals 56 is not reduced too much, preventing an excessive increase in the production cost.

Ink Supply Member

Figure 2:
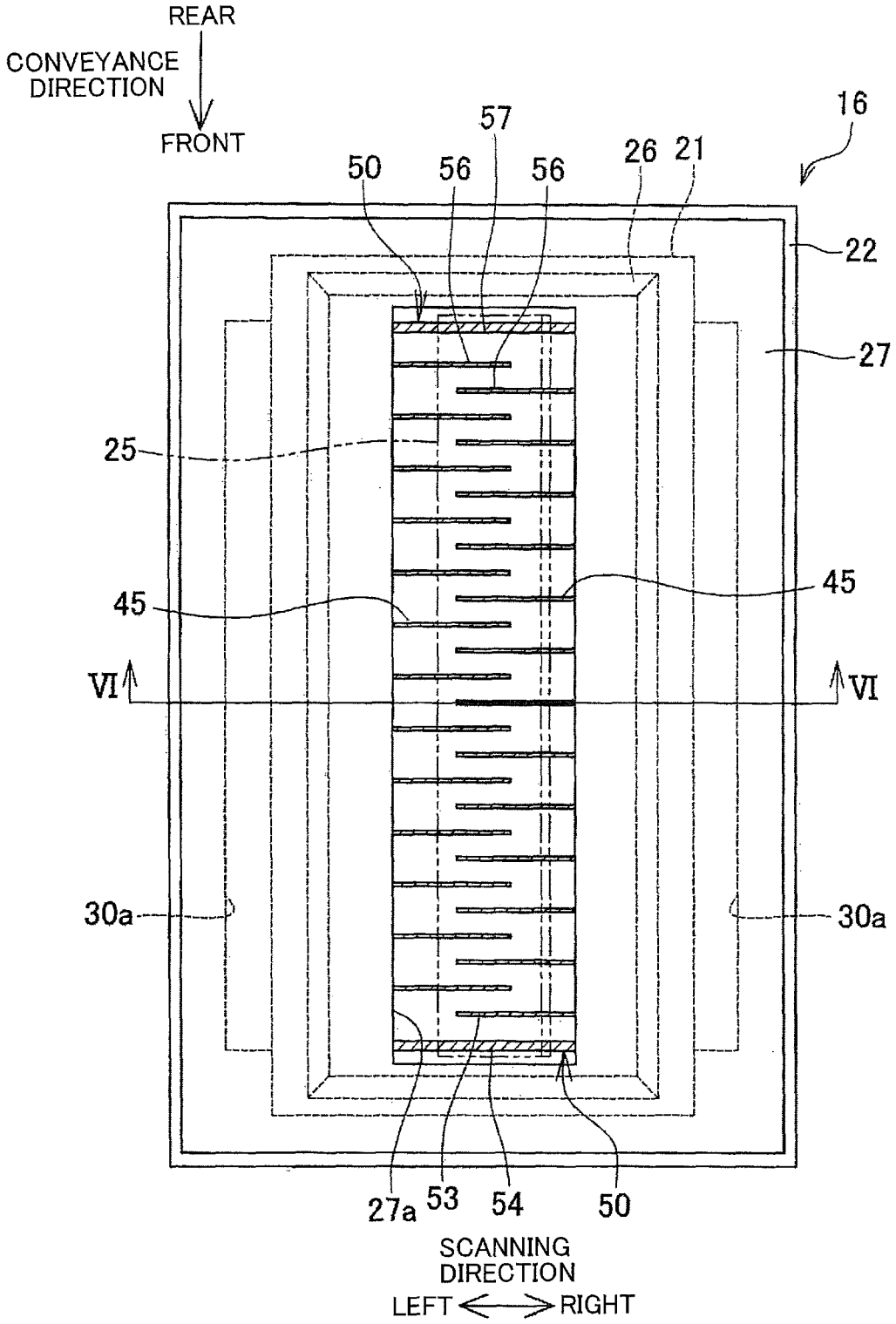
FIG. 2 is a plan view of a head unit 16.

As shown in FIGS. 2 and 6, the ink supply member 27 has a rectangular shape in plan view and has substantially the same size as the second flow-passage defining member 22. The ink supply member 27 is disposed above the second flow-passage defining member 22 and the protective cover 26. The ink supply member 27 is formed of synthetic resin, for instance. The ink supply member 27 has a hole 27*a* formed at its central portion in the scanning direction for permitting the COF 25 extending upward to pass therethrough.

The ink supply member 27 is connected to the holder 7 (FIG. 1) on which the ink cartridges 17 are mounted. Ink supply passages 59 are formed in the ink supply member 27, and a lower end of each ink supply passage 59 is connected to the corresponding manifold 30 formed in the second flow-passage defining member 22. In this configuration, the ink in each ink cartridge 17 mounted on the holder 7 is supplied to the manifolds 30 of the second flow-passage defining member 22 via the ink supply passages 59 of the ink supply member 27.

In the illustrated embodiment, the head unit 16 corresponds to "liquid ejection apparatus". The first flow-passage defining member 21 corresponds to "flow-passage defining member". The sheet conveyance direction corresponds to "first direction" and the scanning direction corresponds to "second direction". The right-side piezoelectric elements 41*x* correspond to "first piezoelectric elements", and the left-side piezoelectric elements 41*y* correspond to "second piezoelectric elements". The upper surface of the oscillating film 40 on which the piezoelectric elements 41 are disposed corresponds to "element disposed surface". Each of the drive wires 45*x* and each of the drive terminals 56*x* for the right-side piezoelectric element 41*x* respectively correspond to "first wire" and "first terminal". Each of the drive wires 45*y* and each of the drive terminals 56*y* for the left-side piezoelectric elements 41*y* respectively correspond to "second wire" and "second terminal". The COF 25 corresponds to "wiring member", and the driver IC 60 corresponds to "driver".

There will be next explained modifications of the illustrated embodiment. In the following modifications, the same reference numerals as used in the illustrated embodiment are used to identify the corresponding components, and explanation thereof is dispensed with.

Figure 9:
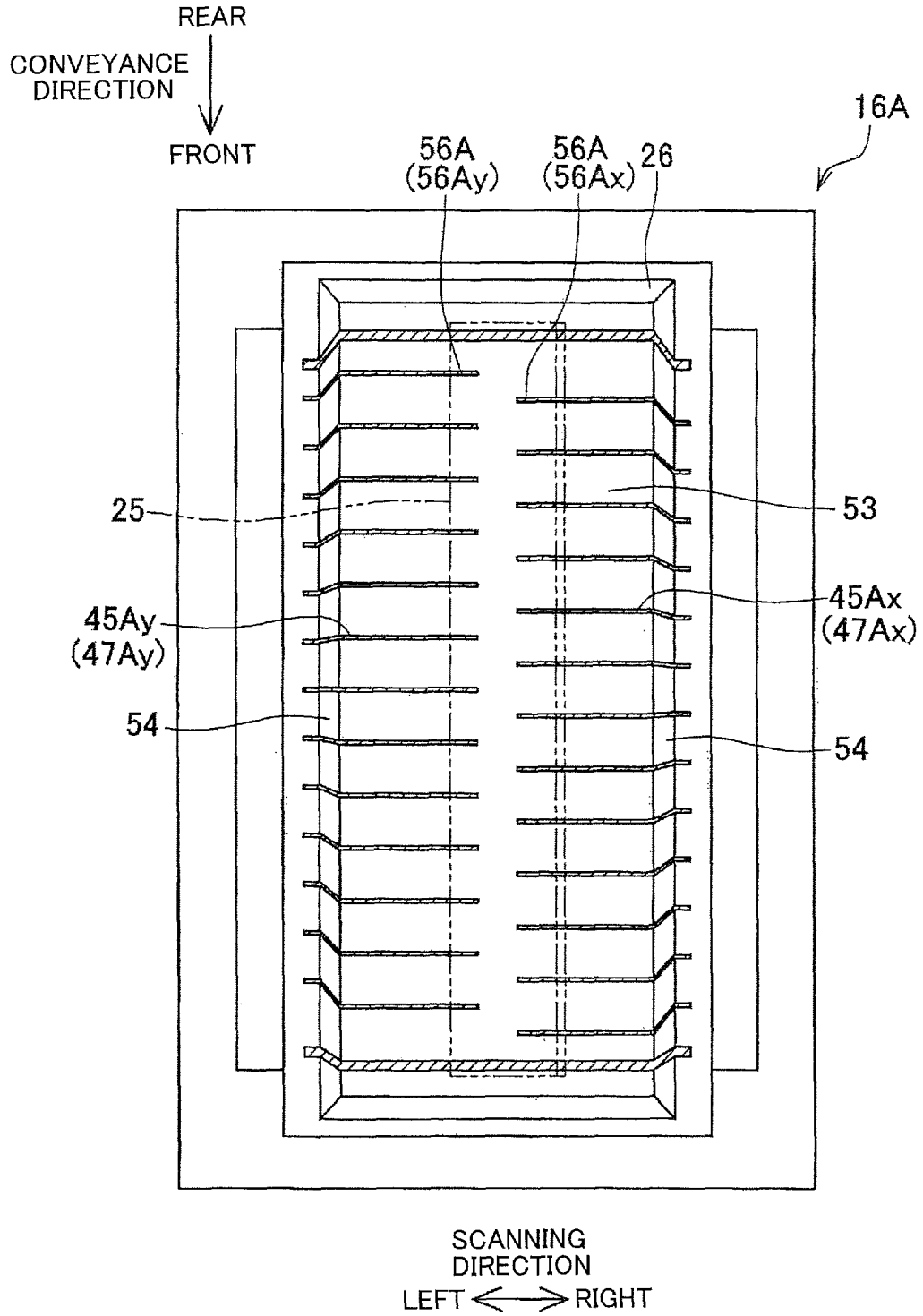
FIG. 9 is a plan view of a head unit 16A according to a modification.

[1] In a head unit 16A shown in FIG. 9, drive terminals 56Ax connected to right-side upper wires 47Ax and drive terminals 56Ay connected to left-side upper wires 47Ay are disposed on the top wall portion 53 of the protective cover 26 so as to be spaced apart relative to each other in the right-left direction. This configuration increases a distance in the front-rear direction between adjacent two of the drive terminals 56A, as compared with the configuration of the illustrated embodiment shown in FIG. 3 in which the drive terminal 56*x* and the drive terminal 56*y* are alternately arranged in the front-rear direction.

Figure 10:
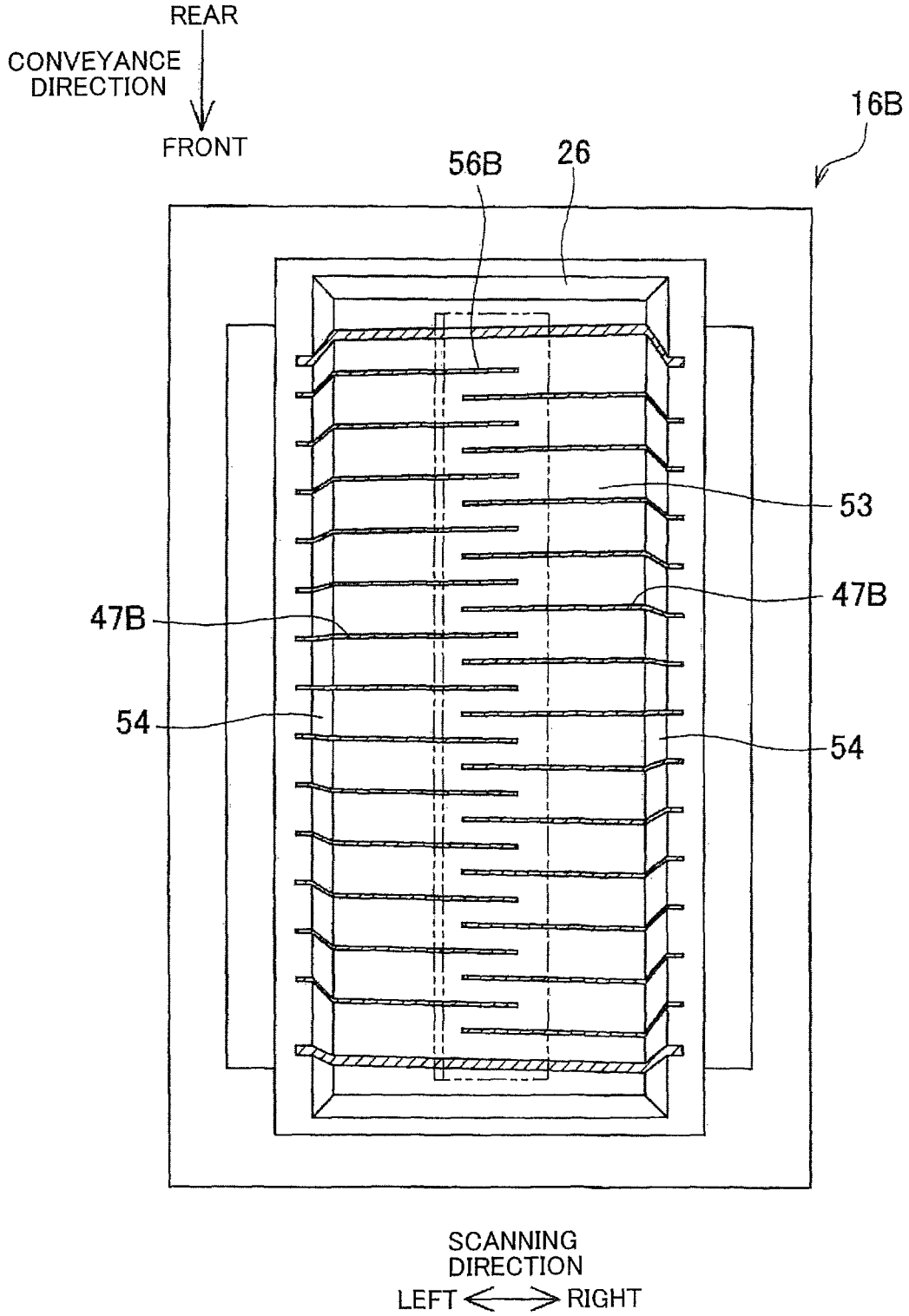
FIG. 10 is a plan view of a head unit 16B according to a modification.

[2] In the illustrated embodiment, the upper wires 47 spread fanwise or radially on each side wall portions 54 but are disposed in parallel with each other on the top wall portion 53. The upper wires 47 may be arranged otherwise. For instance, in a head unit 16B shown in FIG. 10, upper wires 47B spread fanwise or radially also on the top wall portion 53. In FIG. 10, the upper wires 47B may be disposed so as to be in parallel with the right-left direction on the side wall portion 54. That is, the upper wires 47B may be disposed fanwise or radially only on the top wall portion 53.

In FIG. 10, the right-side and left-side upper wires 47B are disposed fanwise or radially so as to spread from the left side toward the right side at the central portion of the top wall portion 53 in the right-left direction. This configuration offers the following advantage. The COF 25 as a whole may expand or contract with respect to a size according to its design specification due to various conditions such as production fluctuations, the environmental temperature, the humidity, and thermal shrinkage in bonding. In this case, when the COF 25 is bonded to the top wall portion 53 at a predetermined position, positions of the terminals of the COF 25 shift or deviate relative to the drive terminals 56B of the top wall portion 53 due to influences of the expansion or contraction. This positional deviation of the terminals of the COF 25 is caused not in a specific direction altogether but fanwise or radially as a whole. In the configuration of FIG. 10 in which the plurality of upper wires 47B are disposed fanwise or radially on the top wall portion 53, it is only required to slightly shift the bonding position of the COF 25 in the right-left direction even if the COF 25 suffers from expansion or contraction, whereby it is possible to align the terminals of the COF 25 and the drive terminals 56B of the top wall with one another.

In FIG. 10, the upper wires 47B extend so as to spread radially from the left side toward the right side at the central portion of the top wall portion 53. The COF 25 is disposed such that its distal end faces rightward and the rest (left-side) is bent and extends upward. Here, it is natural that the wires of the COF 25 are formed at the distal portion bonded to the top wall portion 53, such that the wires spread fanwise from the left side (on which the bent portion is located) toward the right side, like the upper wires 47B formed on the top wall portion 53. In other words, it is natural that the wires of the COF 25 are formed such that the distance between adjacent two wires gradually increases toward the distal end of the COF 25. On the contrary, in an instance where the distal end of the COF 25 faces leftward, the wires of the COF 25 are formed such that the distance between adjacent two wires gradually decreases from the right side (on which the bent portion is located) toward the left side, namely, toward the distal end of the COF 25. In terms of simplification of electrical connection by increasing the distance between adjacent two wires at the distal portion of the COF 25, it is preferable that the COF 25 is bonded such that the distal portion faces rightward as shown in FIG. 10.

[3] In an instance where the distance between adjacent two of the lower wires 46 on the upper surface of the oscillating film 40 differs from the distance between adjacent two of the upper wires 47 on the outer surface of the protective cover 26, the wire length differs among the drive wires 45 for the respective piezoelectric elements 41. The difference in the wire length causes a difference in an electric resistance of the wires, resulting in a difference in a degree of dullness of waveforms of the drive signal. Specifically, in an instance where the drive signal is a pulse signal, there are generated fluctuations in a pulse rise time (Tr) and a pulse fall time (Tf), causing fluctuations in the behavior among the piezoelectric elements 41. In view of this fact, it is preferable to employ a configuration in which a difference in the electric resistance among the drive wires 45 is small. Some of such configurations will be explained.

(1) In the configuration of the illustrated embodiment shown in FIGS. 3 and 8 in which the distance between adjacent two of the upper wires 47 is increased on the side wall portion 54, the extension direction differs among the upper wires 47, and the wire length accordingly differs among the upper wires 47. In view of this, the upper wires 47 may have different lengths on the top wall portion 53 to compensate for the difference in the wire length on the side wall portion 54.

Figure 11:
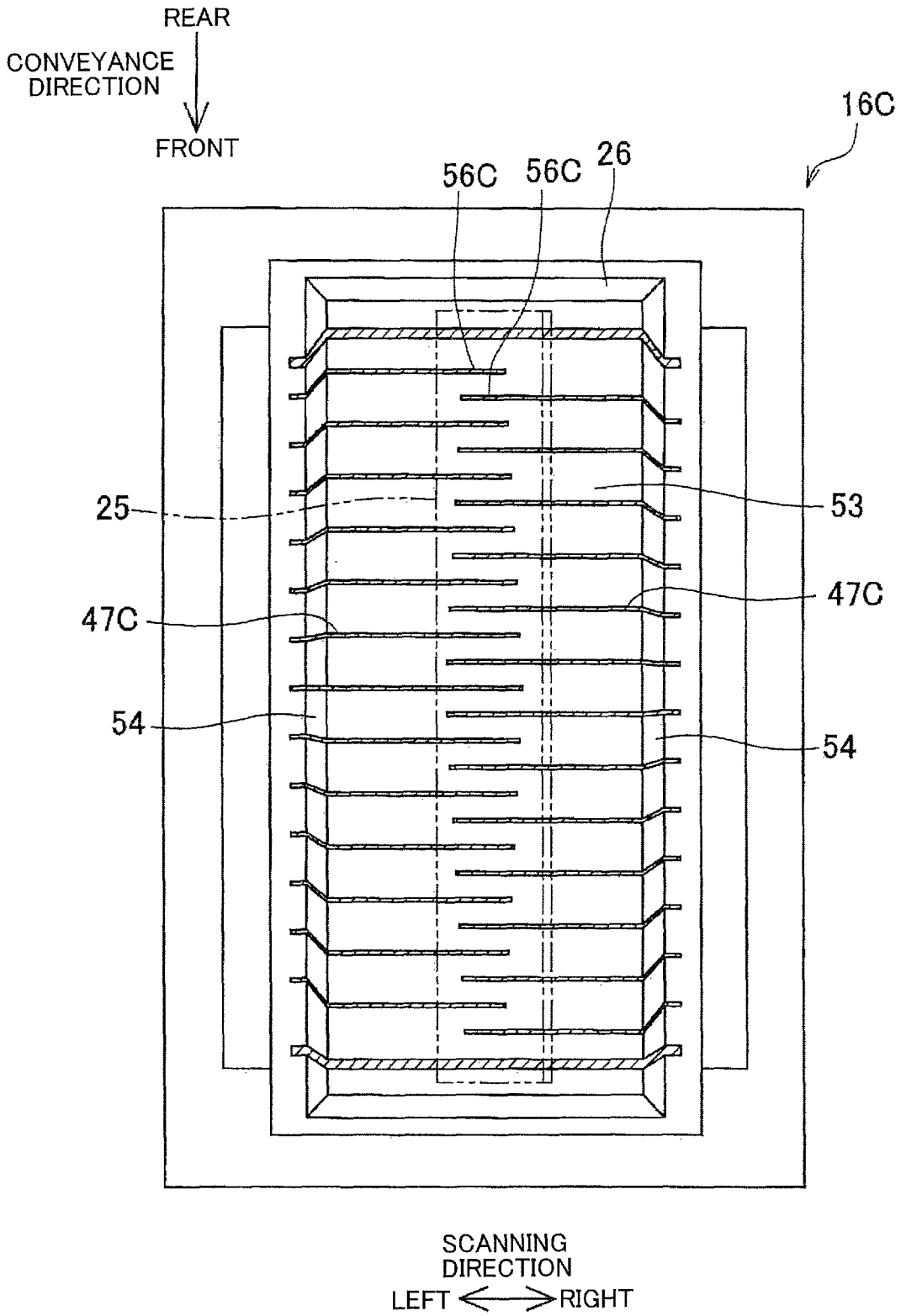
FIG. 11 is a plan view of a head unit 16C according to a modification.

FIG. 11 shows a head unit 16C. This configuration will be explained focusing on only right-side or left-side upper wires 47C. The plurality of upper wires 47C are formed so as to spread fanwise or radially on the side wall portion 54. Further, positions of end portions of the respective upper wires 47C (i.e. positions of the drive terminals 56) in the right-left direction are shifted relative to one another on the top wall portion 53. A plurality of drive terminals 56C which are connected to the upper wires 47C having a longer length on the side wall portion 54, specifically, the drive terminals 56C which are located nearer to opposite end portions in the front-rear direction of the protective cover 26, are located nearer to the side wall portion 54 on which the upper wires 47C connected thereto extend. That is, the length of the upper wires 47C on the top wall portion 53 decreases with an increase in the length thereof on the side wall portion 54. The length on the top wall portion 53 is thus made different among the upper wires 47C, thereby reducing a difference in the entire length among the plurality of drive wires, namely, a difference in the electric resistance among the plurality of drive wires.

In the configuration of FIG. 11, the position of the drive terminals 56 is adjusted for all of the upper wires 47C such that the drive terminals 56 connected to the upper wires 47C having a longer length on the side wall portion 54 are located nearer to the side wall portion 54. The positional adjustment of the drive terminals 56 may be performed for only a part of the upper wires 47C. That is, the upper wires 47C may include a long wire (i.e., the upper wires located nearer to the opposite end portions of the protective cover 26 in the front-rear direction) and a short wire (i.e., the upper wires located nearer to the central portion of the protective cover 26 in the front-rear direction) each having a length on the side wall portion 54 shorter than the long wire. The drive terminal 56 connected to the long wire may be located nearer to the side wall portion 54 than the drive terminal 56 connected to the short wire.

In FIG. 11, however, the upper wires 47C spread fanwise or radially on the side wall portion 54, so that the region in which the drive terminals 56C are disposed is widened in the right-left direction on the upper surface of the top wall portion 53, and the region of the terminals of the COF 25 is accordingly widened in the right-left direction. That is, the bonding surface of the COF 25 is increased. In this case, when pressing and bonding the COF 25 on and to the top wall portion 53, there may be a risk that a part of the terminals of the COF 25 is not sufficiently pressed on the top wall portion 53, causing insufficient connection with the drive terminals 56C.

Figure 12:
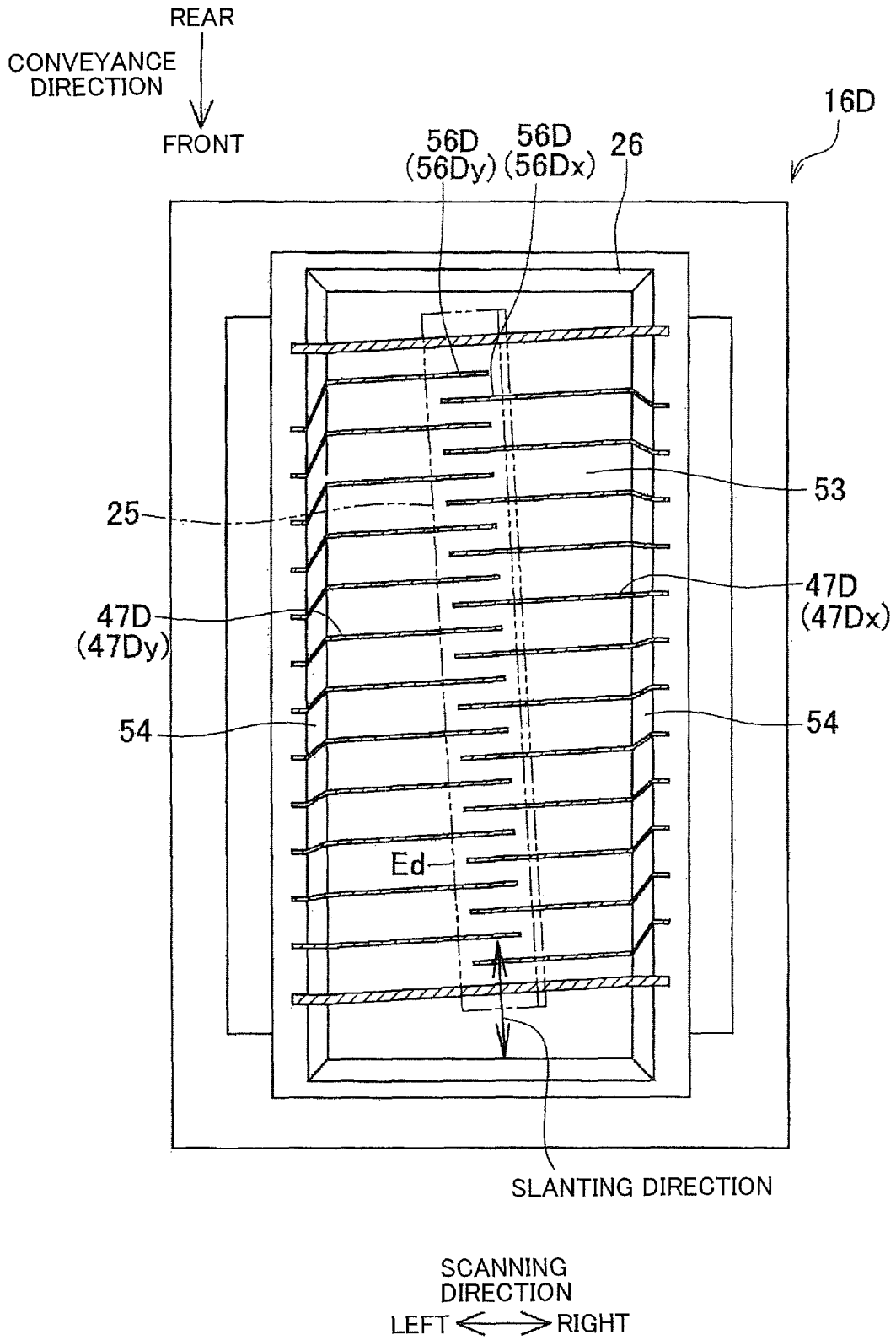
FIG. 12 is a plan view of a head unit 16D according to a modification.

In view of the above, in a head unit 16D shown in FIG. 12, upper wires 47D which are located nearer to one of the opposite end portions of the protective cover 26 in the front-rear direction have a longer length on the side wall portion 54. That is, among right-side upper wires 47Dx, the upper wires 47Dx located nearer to the front side have a longer length on the side wall portion 54. Likewise, among left-side upper wires 47Dy, the upper wires 47Dy located nearer to the rear side have a longer length on the side wall portion 54.

In the configuration of FIG. 12, drive terminals 56D which are located nearer to the one of the opposite end portions of the protective cover 26 in the front-rear direction are located, on the top wall portion 53, nearer to the side wall portion 54 in the right-left direction. Thus, drive terminals 56Dx for right-side upper wires 47Dx and drive terminals 56Dy for left-side upper wires 47Dy are arranged in a slanting direction that intersects both of the front-rear direction and the right-left direction. Further, the distal portion of the COF 25 is disposed on the upper surface of the protective cover 26 so as to extend in the slanting direction, and the wires of the COF 25 are connected to the drive terminals 56D. In this configuration, all of the drive terminals 56D are arranged in the slanting direction, resulting in a decrease in the width of the region of the drive terminals 56D so as to enhance the reliability of electrical connection with the COF 25. In FIG. 12, the upper wires 47D extend on the top wall portion 53 in a direction orthogonal to the slanting direction. This enables the wires of the COF 25 to be formed on the distal portion of the COF 25 so as to be orthogonal to a distal edge Ed, simplifying formation of the wires.

(2) In an instance where the wire length on the side wall portion 54 differs among the upper wires 47, the upper wires 47 may have different cross-sectional areas in a plane orthogonal to the extension direction thereof, so as to reduce a difference in the electric resistance among the upper wires 47. In a head unit 16E shown in FIG. 13, among upper wires 47E, the upper wires 47E located at outer portions of the protective cover 26 in the front-rear direction (located nearer to the opposite end portions of the protective cover 26 in the front-rear direction) and having a longer length on the side wall portion 54 have a larger width. Instead, the thickness may be made different among the upper wires 47E.

Figure 13:
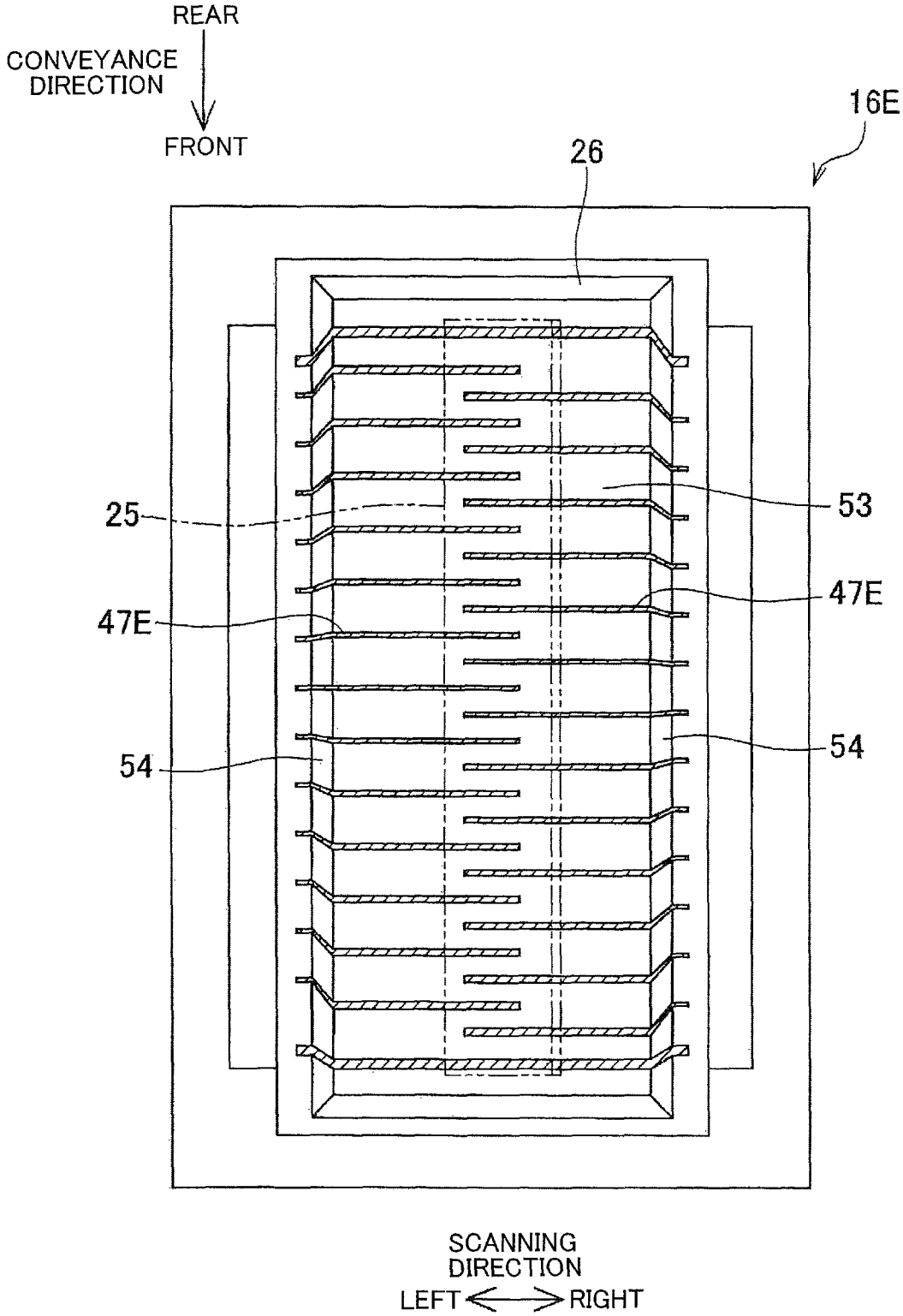
FIG. 13 is a plan view of a head unit 16E according to a modification.

The adjustment of the cross-sectional area explained with respect to FIG. 13 may be applied to only a part of the upper wires 47E. That is, the upper wires 47E may include a long wire (i.e., the upper wires located nearer to the opposite end portions of the protective cover 26 in the front-rear direction) and a short wire (i.e., the upper wires located nearer to the central portion of the protective cover 26 in the front-rear direction) each having a shorter length on the side wall portion 54 than the long wire. In this case, the long wire may have a larger cross-sectional area than that of the short wire.

(3) By varying inclination in one side wall portion, the wire length on the one side wall portion may be made different among the upper wires formed thereon. In a head unit 16F shown in FIG. 14, a central portion of a side wall portion 54F in the front-rear direction protrudes outward at its lower end, thereby providing a first inclined portion 61 and a second inclined portion 62. The first inclined portion 61 and the second inclined portion 62 have different inclination degrees and are arranged in the front-rear direction. Specifically, the central portion of the side wall portion 54F near a ridge line R corresponds to the first inclined portion 61 which is gently inclined, and the front or rear end portion of the side wall portion 54F corresponds to the second inclined portion 62 which is steeply inclined. The second inclined portion 62 is steeper than the first inclined portion 61 and accordingly has a smaller dimension in the right-left direction than the first inclined portion 61.

Figure 14:
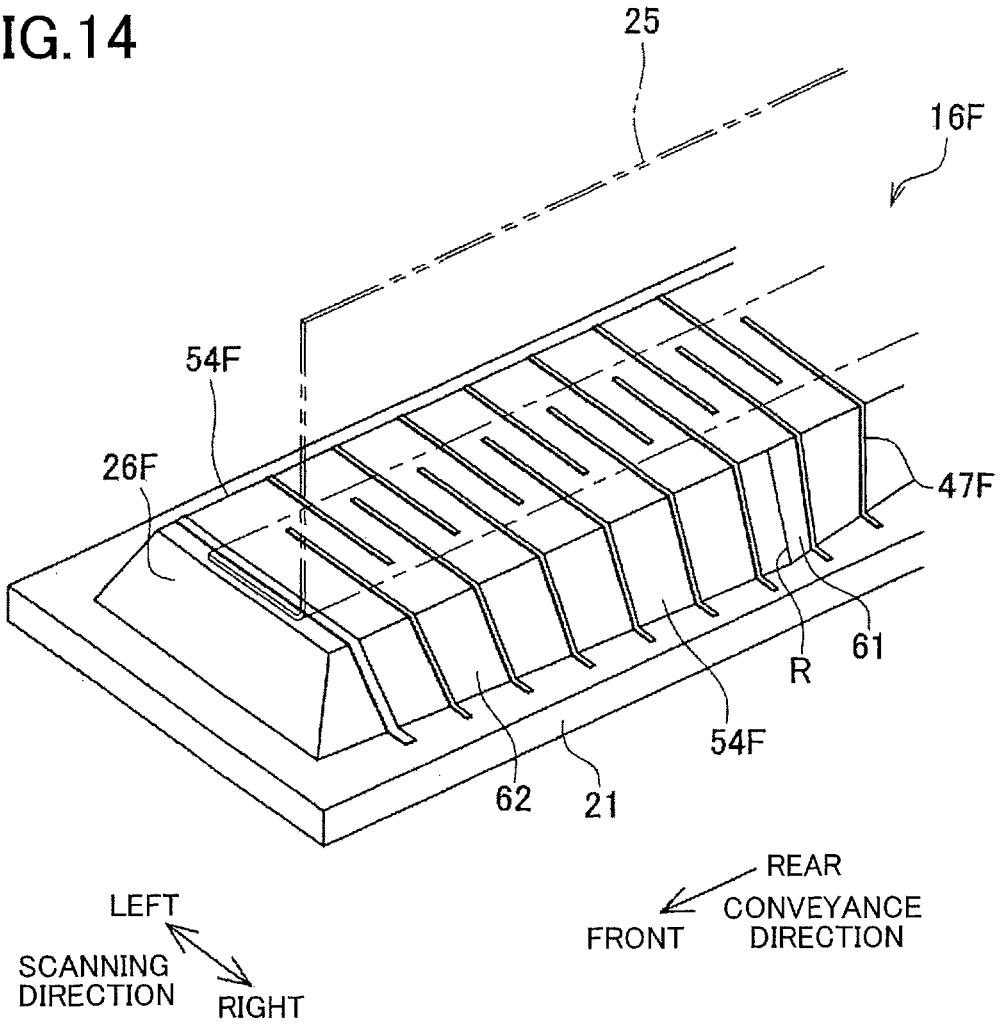
FIG. 14 is a perspective view of the first flow-passage defining member and a protective cover 26F of a head unit 16F according to a modification.

Upper wires 47F formed on one side wall portion 54F spread fanwise or radially from the central portion in the front-rear direction to the opposite end portions in the front-rear direction. That is, the upper wires 47F disposed at the front and rear end portions of the side wall portion 54F are inclined with respect to the right-left direction at a larger angle than the upper wires 47F disposed at the central portion of the side wall portion 54F. In the illustrated embodiment (as shown in FIGS. 3 and 4), each side wall portion 54 is inclined at a constant angle, and the upper wires 47 disposed at the front and rear end portions of one side wall portion 54 accordingly have a longer length than the upper wires 47 disposed at the central portion. In the configuration of FIG. 14, however, the second inclined portion 62 corresponding to the front or rear end portion of the one side wall portion 54F is inclined more steeply than the first inclined portion 61 corresponding to the central portion of the one side wall portion 54F. The difference in the inclination degree between the first inclined portion 61 and the second inclined portion 62 results in an increase in the length of the upper wires 47F disposed at the central portion. It is thus possible to reduce the difference in the length on the side wall portion 54F among the upper wires 47F, which difference arises from the difference in the extension direction of the upper wires 47F on the side wall portion 54F. In the configuration of FIG. 14, a change in the inclination degree is continuous between the first inclined portion 61 and the second inclined portion 62. There may be provided a step between the first inclined portion 61 and the second inclined portion 62, and the inclination degree may abruptly change at the step.

[4] In the illustrated embodiment (as shown in FIGS. 4 and 6), the drive terminals 56 connected to the COF 25 are disposed at the central portion of the upper surface of the top wall portion 53. The drive terminals 56 may be disposed otherwise. In a head unit 16G shown in FIGS. 15 and 16, drive terminals 56G are disposed at one end of the top wall portion 53 in the right-left direction. The one end of the top wall portion 53 is close to the side wall portion 54 and is less likely to be bent or deformed when the COF 25 is pressed and bonded. Consequently, the COF 25 can be sufficiently strongly pressed onto the protective cover 26, enhancing the reliability in electrical connection. In the configuration shown in FIGS. 15 and 16, drive terminals 56Gx for right-side upper wires 47Gx and drive terminals 56Gy for left-side upper wires 47Gy are both disposed at the one end (right end) of the top wall portion 53, simplifying connection with the COF 25.

Figure 15:
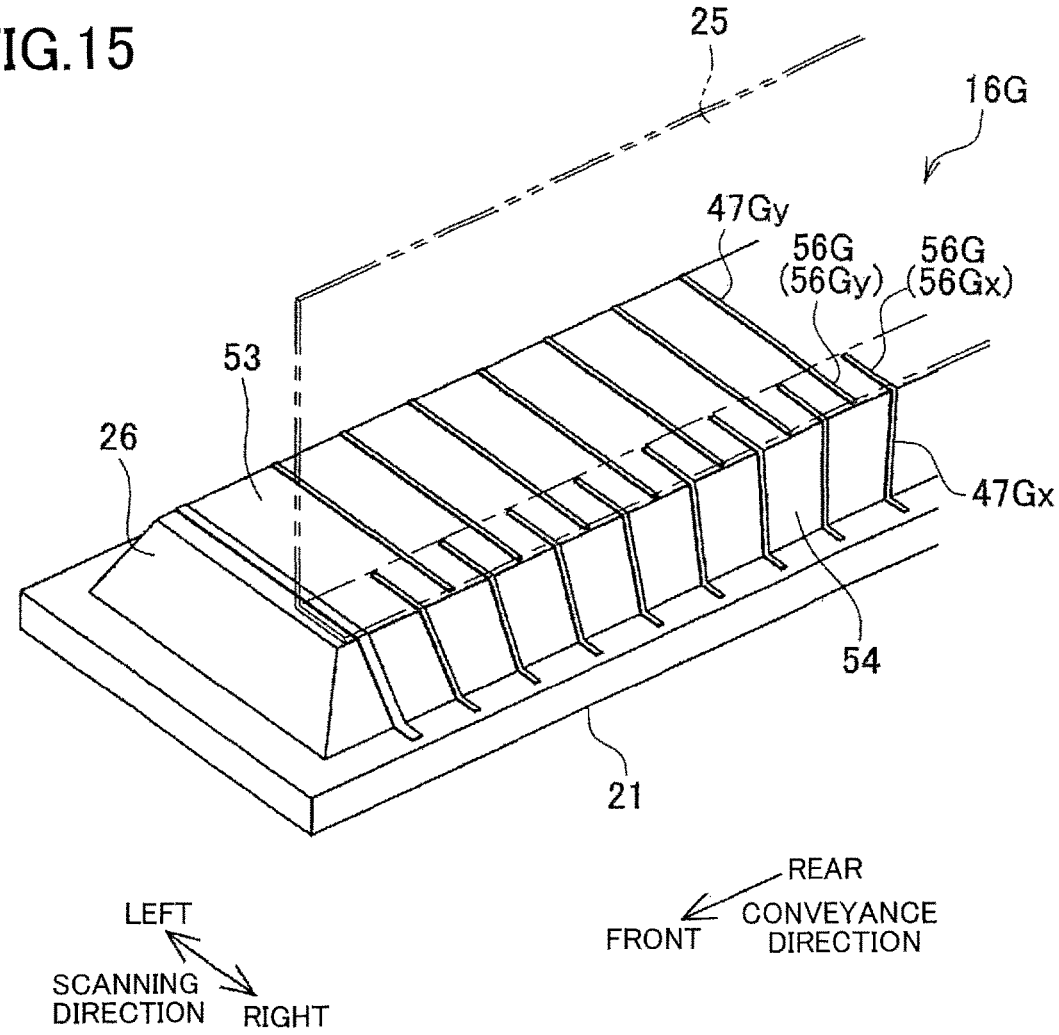
FIG. 15 is a perspective view of the first flow-passage defining member and the protective cover of a head unit 16G according to a modification.
Figure 16:
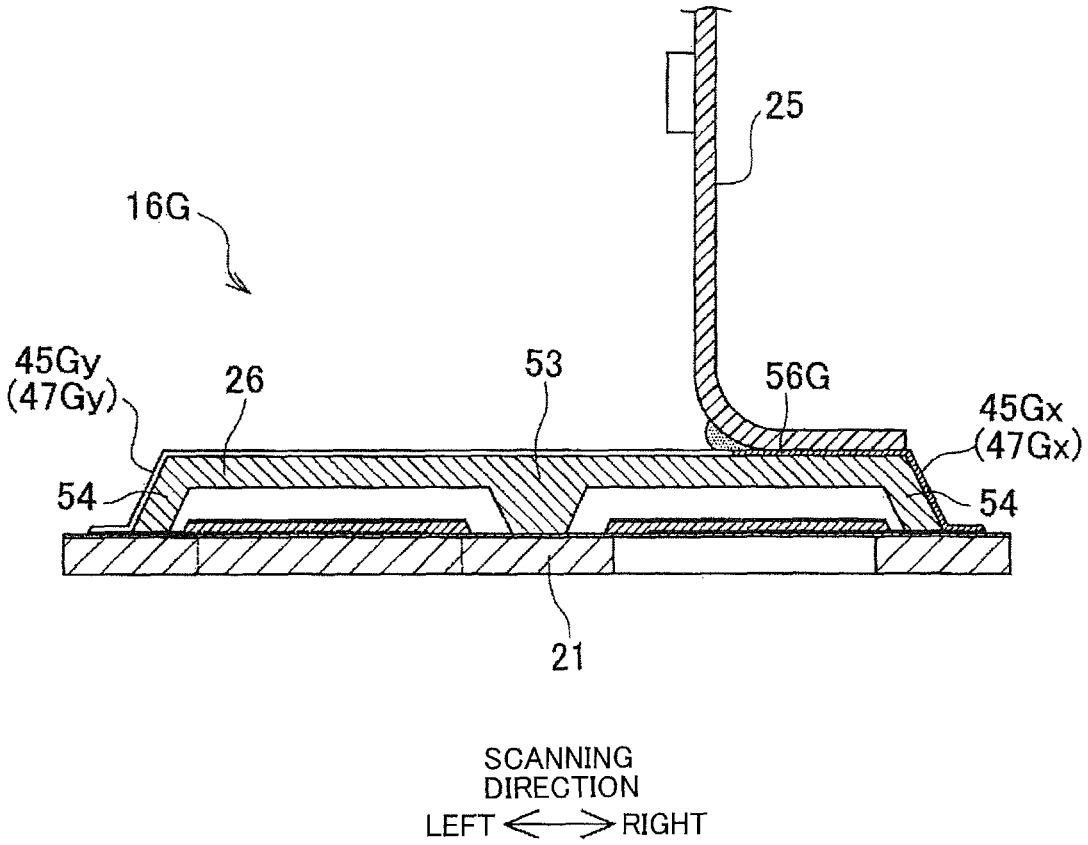
FIG. 16 is a cross-sectional view of the first flow-passage defining member and the protective cover of FIG. 15.

In the configuration shown in FIGS. 15 and 16, the COF 25 is bonded to the protective cover 26 in a posture in which the distal end of the COF 25 is oriented outward (rightward). As in the illustrated embodiment, the COF 25 may be bonded to the protective cover 26 in a posture in which the distal end of the COF 25 is oriented toward the central portion.

Figure 17:
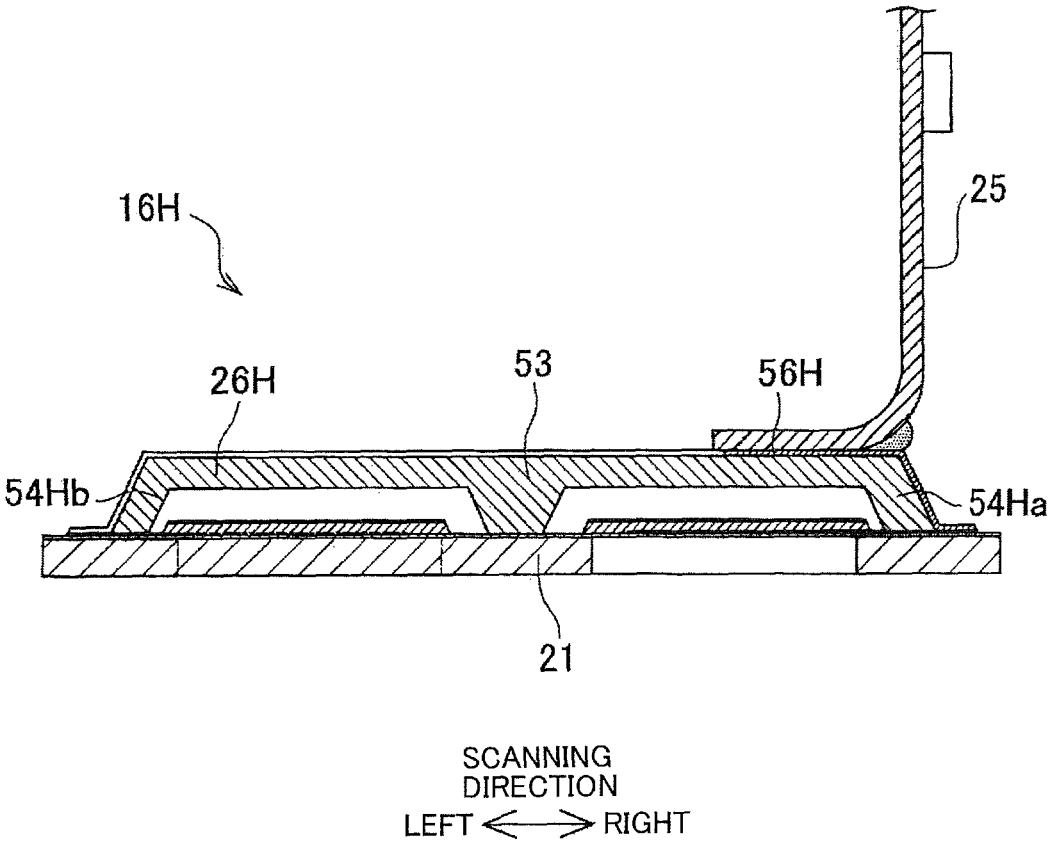
FIG. 17 is a cross-sectional view of the first flow-passage defining member and the protective cover of a head unit 16H according to a modification.

When the COF 25 is pressed on and bonded to the right end of the protective cover 26 in the configuration shown in FIG. 15, a substantial part of the pressing force acts so as to be concentrated on the side wall portion 54 located at the right end. In view of this, in a head unit 16H shown in FIG. 17, a right side wall portion 54Ha of a protective cover 26H nearer to drive terminals 56H have a larger thickness than a left side wall portion 54Hb. With this configuration, the right side wall portion 54Ha has a higher strength and can withstand the pressing force that acts thereon when the COF 25 is bonded.

In the configuration of FIG. 15 in which all of the drive terminals 56G are disposed at the right end of the top wall portion 53, the upper wires 47Gy extending from the left side wall portion 54 have a longer length than the upper wires 47Gx extending from the right side wall portion 54 and accordingly have a higher electric resistance. In view of this, it is preferable to take some measures for reducing a difference in the electric resistance between the right-side upper wires and the left-side upper wires.

Figure 18:
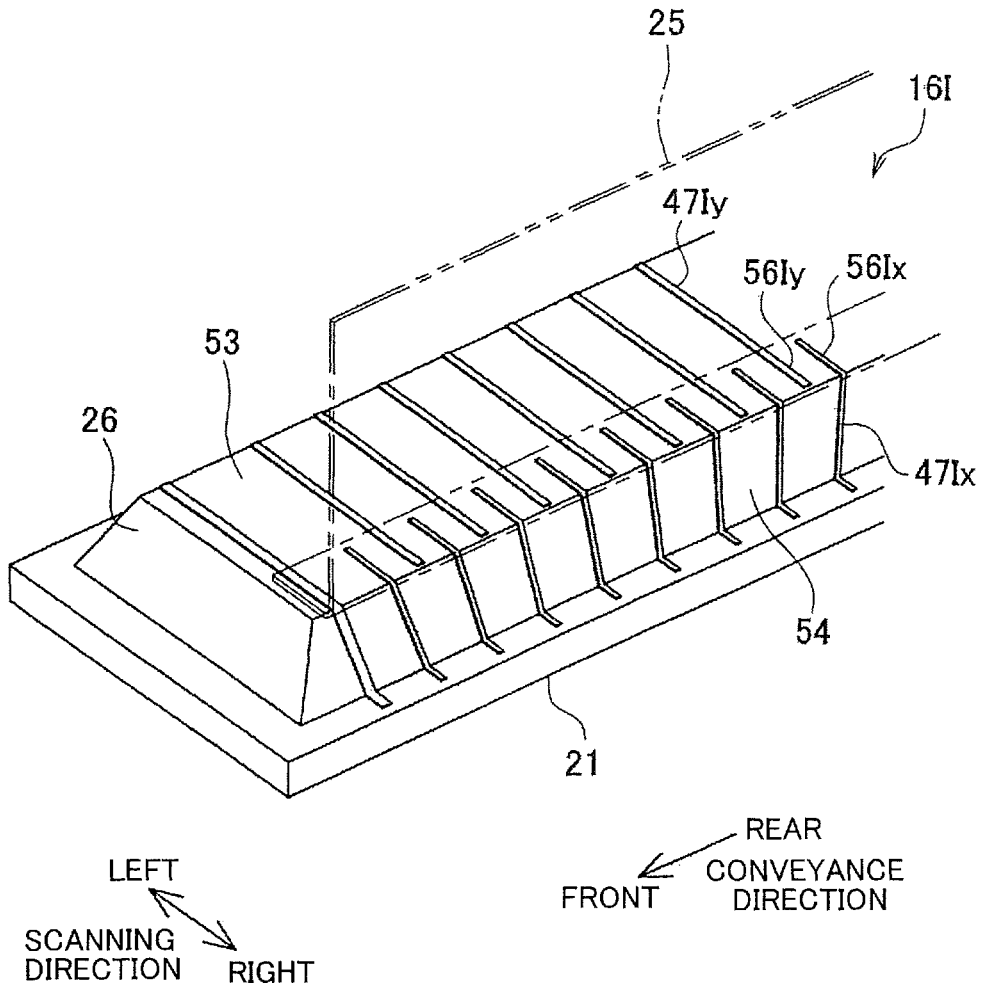
FIG. 18 is a perspective view of the first flow-passage defining member and the protective cover of a head unit 16I according to a modification.

For instance, the right-side upper wires and the left-side upper wires may have mutually different cross-sectional areas in the plane orthogonal to the extension direction of the upper wires. In a head unit 16I shown in FIG. 18, all of drive terminals 56Ix, 56Iy are disposed at the right end of the upper surface of the top wall portion 53, and left-side upper wires 47Iy have a larger width than right-side upper wire 47Ix. Instead, the left-side upper wires 47Iy may have a larger thickness than the right-side upper wires 47Ix. The cross-sectional area of the left-side upper wires 47Gy are made larger than that of the right-side upper wires 47Gx, whereby it is possible to reduce a difference in the electric resistance between the right-side and left-side upper wires 47G, which difference arises from a difference in the wire length.

Figure 19:
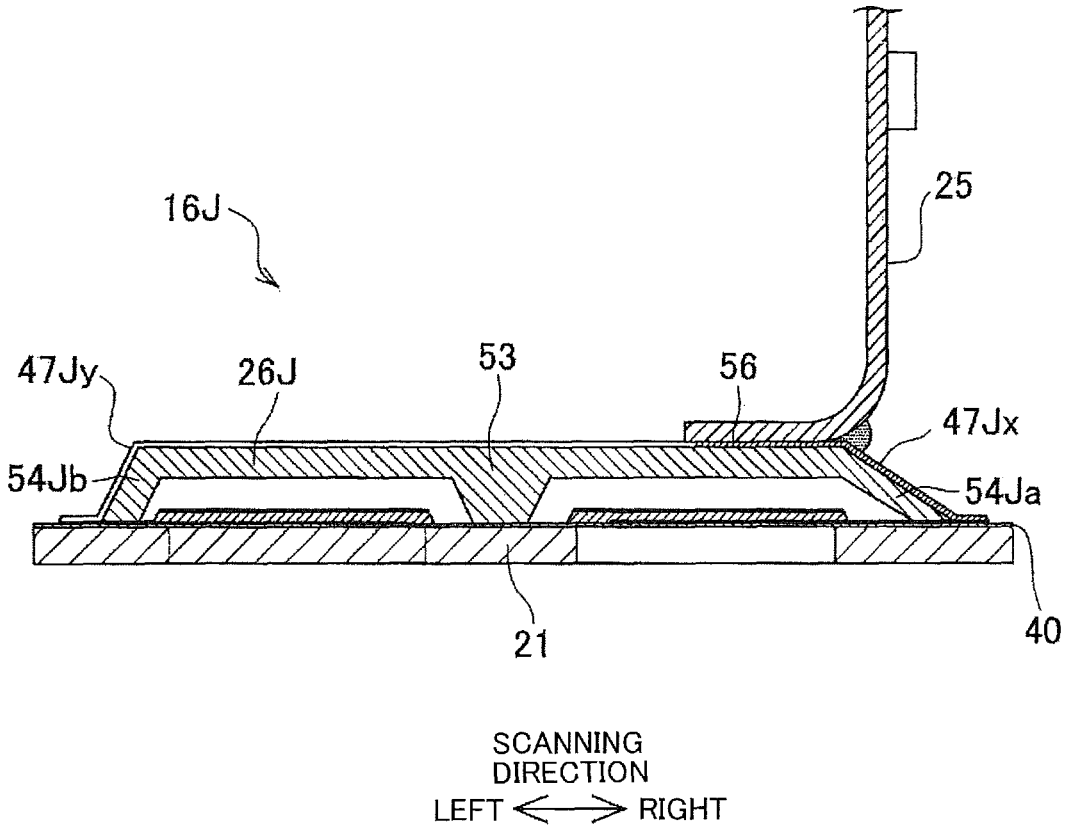
FIG. 19 is a cross-sectional view of the first flow-passage defining member and a protective cover 26J of a head unit 16J according to a modification.

For reducing the difference in the length between the right-side and left-side upper wires, the two side wall portions, i.e., the right and left side wall portions, may be inclined at mutually different angles. In a protective cover 26J of a head unit 16J shown in FIG. 19, an inclination angle of a right side wall portion 54Ja near to the drive terminals 56 with respect to the oscillating film 40 is smaller than an inclination angle of a left side wall portion 54Jb remote from the drive terminals 56. The right side wall portion 54Ja which is inclined gently has a larger dimension in the right-left direction than the left side wall portion 54Jb which is inclined steeply, so that right-side upper wires 47Jx have a longer length. Thus, the difference in the length between the right-side upper wires 47Jx and the left-side upper wires 47Jy can be reduced.

Figure 20:
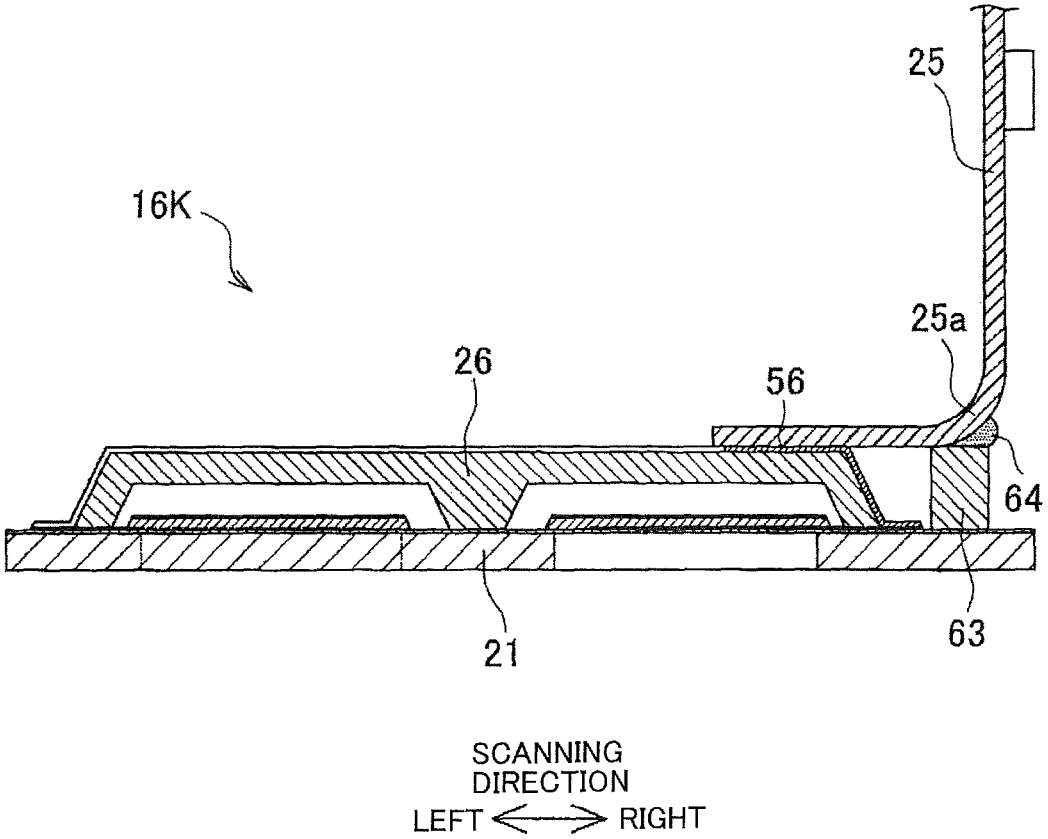
FIG. 20 is a cross-sectional view of the first flow-passage defining member and the protective cover of a head unit 16K according to a modification.

[5] The bent portion 25*a* of the COF 25 is not necessarily required to be supported by or fixed to the protective cover. In a head unit 16K shown in FIG. 20, the bent portion 25*a* of the COF 25 is supported by a support 63 formed on the first flow-passage defining member 21. The COF 25 may be fixed to the support 63 by a fixing portion 64 (as one example of "anchorage") formed by solidification or hardening of a liquid solidifying agent such as hardening resin. As in the illustrated embodiment shown in FIG. 7, the recess for receiving the liquid solidifying agent may be formed in the first flow-passage defining member 21 or the support 63.

[6] Two or more COFs may be bonded to the protective cover. For instance, one COF is bonded to the right portion of the top wall portion of the protective cover, and another COF is bonded to the left portion of the top wall portion. The right COF is connected to the drive wires (the drive terminals) extending from the right side wall portion of the protective cover, and the left COF is connected to the drive wires (the drive terminals) extending from the left side wall portion of the protective cover. This configuration makes it possible to increase a distance between adjacent two terminals of each COF, resulting in a decrease in the production cost of the COF.

[7] The piezoelectric elements 41 covered by the protective cover may be arranged in one row. In this case, the drive wires may be drawn from the piezoelectric elements 41 arranged in one row alternately in the rightward direction and the leftward direction. Alternatively, the drive wires may be drawn from the piezoelectric elements 41 arranged in one row toward the same direction. In an instance where the drive wires are drawn toward the same direction, the upper wires may be provided on only one of the two side wall portions of the protective cover.

[8] In the illustrated embodiment, the driver IC 60 is mounted on the COF 25 as the wiring member, and the driver IC 60 is electrically connected to the drive terminals 56 via the COF 25. The driver IC 60 may be connected directly to the drive terminals 56 on the upper surface of the protective cover 26 not via the wiring member.

In the illustrated embodiment, the present disclosure is applied to the ink-jet head configured to eject the ink on the recording sheet so as to print images or the like thereon. The present disclosure is applicable to other liquid ejection apparatus in a variety of uses other than printing of images. For instance, the present disclosure is applicable to a liquid ejection apparatus configured to eject a conductive liquid onto a substrate so as to form a conductive pattern on the surface of the substrate.

What is claimed is:

1. A liquid ejection apparatus, comprising:

a plurality of piezoelectric elements disposed on an element-disposed surface of a flow-passage defining member so as to be arranged in a first direction;

a protective cover disposed on the element-disposed surface so as to cover the plurality of piezoelectric elements and including a top wall portion opposed to the plurality of piezoelectric elements and two side wall portions connected respectively to opposite end portions of the top wall portion in a second direction parallel to the element-disposed surface and orthogonal to the first direction;

a plurality of wires drawn respectively from the plurality of piezoelectric elements to an outside of the protective cover in the second direction and extending on an outer surface of the top wall portion of the protective cover, the plurality of wires comprising (a) a plurality of first wires extending toward a first side of the protective cover in the second direction and (b) a plurality of second wires extending toward a second side, opposite to the first side of the protective cover in the second direction, the plurality of first wires comprising a plurality of lower portions extending on the element-disposed surface of the flow-passage defining member and a plurality of upper portions extending on the outer surface of the top portion of the protective cover;

a plurality of terminals disposed on the outer surface of the top wall portion and connected respectively to the plurality of wires; and a driver electrically connected to the plurality of terminals, wherein a distance in the first direction between two of the plurality of upper portions of two of the plurality of first wires is larger than a distance in the first direction between two of the plurality of lower portions of the two of the plurality of first wires.

2. The liquid ejection apparatus according to claim 1, wherein the plurality of first wires are drawn respectively from a plurality of first piezoelectric elements of the plurality of piezoelectric elements toward the first side of the protective cover in the second direction and extend on the outer surface of the top wall portion, wherein the liquid ejection apparatus further comprises:

a plurality of second piezoelectric elements of the plurality of piezoelectric elements disposed on the element-disposed surface so as to be arranged in the first direction and disposed on a second side of the protective cover in the second direction with respect to the plurality of first piezoelectric elements, such that a row of the plurality of first piezoelectric elements and a row of the plurality of second piezoelectric elements are arranged in the second direction;

the plurality of second wires connected respectively to the plurality of second piezoelectric elements, drawn respectively from the plurality of second piezoelectric elements toward the second side of the protective cover in the second direction, and extending on the outer surface of the top wall portion, the plurality of second wires comprising (a) a plurality of lower portion extending on the element-disposed surface of the flow-passage defining member and (b) a plurality of upper portion extending on the outer surface of the top portion of the protective cover;

a plurality of first terminal of the plurality of terminals disposed on the outer surface of the top wall portion and connected respectively to the plurality of first wires, the driver electrically connected to the plurality of first terminals; and a plurality of second terminals disposed on the outer surface of the top wall portion and connected respectively to the plurality of second wires, the driver being electrically connected to the plurality of second terminals, the plurality of second terminals being different from the plurality of first terminals, wherein a distance in the first direction between two of the plurality of upper portion of two of the plurality of second wires is larger than a distance between two of the plurality of lower portion of the two of the plurality of second wires.

3. The liquid ejection apparatus according to claim 2, wherein the plurality of first terminals and the plurality of second terminals are disposed on the outer surface of the top wall portion so as to be spaced apart from one another in the second direction.

4. The liquid ejection apparatus according to claim 1, further comprising an anchorage by which the driver is fixed to the protective cover.

5. The liquid ejection apparatus according to claim 4, wherein the anchorage is formed by hardening of a liquid fixing agent.

6. The liquid ejection apparatus according to claim 5, wherein the one of the protective cover and the flow-passage defining member has a recess into which the liquid fixing agent is applied.

7. The liquid ejection apparatus according to claim 6, wherein the recess is formed in a region of the protective cover which is away from a region thereof in which the plurality of terminals are disposed.

8. The liquid ejection apparatus according to claim 1, wherein the plurality of first wires comprises a plurality of intermediate portions extending on an outer surface of a first side wall portion of the two side wall portions of the protective cover in the second direction, the first side wall portion being located on the first side in the second direction, and wherein a distance in the first direction between two of the plurality of intermediate portions of two of the plurality of first wires is larger than a distance in the first direction between two of the plurality of lower portions of the two of the plurality of first wires.

9. The liquid ejection apparatus according to claim 8, wherein the plurality of first wires include a long wire and a short wire having a length on the first side wall portion shorter than that of the long wires, and wherein a terminal of the plurality of terminals connected to the long wire is disposed nearer to the first side wall portion in the second direction than a terminal of the plurality of terminals connected to the short wire.

10. The liquid ejection apparatus according to claim 8, wherein a difference in a length on the first side wall portion of the plurality of first wires results from a difference in an extension direction of the plurality of first wires on the first side wall portion, and wherein the plurality of terminals connected to the plurality of first wires having a longer length on the first side wall portion are located nearer to the first side wall portion in the second direction.

11. The liquid ejection apparatus according to claim 10, wherein the plurality of first wires located nearer to one end of the protective cover in the first direction have a longer length on the first side wall portion, and wherein the plurality of terminals are arranged on the outer surface of the top wall portion such that the plurality of terminals located nearer to the one end of the protective cover in the first direction are located nearer to the first side wall portion in the second direction and such that the plurality of terminals are arranged in a third direction intersecting both of the first direction and the second direction.

12. The liquid ejection apparatus according to claim 8, wherein the plurality of first wires include a long wire and a short wire having a length on the first side wall portion shorter than that of the long wire, and wherein the long wire has a cross-sectional area in a plane orthogonal to an extension direction thereof larger than that of the short wire.

13. The liquid ejection apparatus according to claim 8, wherein a difference in a length on the first side wall portion of the plurality of first wires results from a difference in an extension direction of the plurality of first wires on the first side wall portion, and wherein the plurality of first wires having a larger length on the first side wall portion have a larger cross-sectional area in a plane orthogonal to the extension direction.

14. The liquid ejection apparatus according to claim 1, wherein the side wall portion is inclined inward in the second direction relative to a direction orthogonal to the element-disposed surface, wherein the side wall portion includes a first inclined portion and a second inclined portion arranged so as to be continuous to the first inclined portion in the first direction, the second inclined portion being inclined more steeply than the first inclined portion and having a smaller dimension in the second direction than the first inclined portion, wherein the plurality of first wires extend in different directions on the side wall portion, and wherein one wire of the plurality of first wires disposed on the second inclined portion defines a larger angle with respect to the second direction on the side wall portion than another wire of the plurality of first wires disposed on the first inclined portion, so as to reduce a difference in a length between the one wire disposed on the second inclined portion and said another wire disposed on the first inclined portion, which difference arises from a difference in an extension direction of the plurality of first wires on the side wall portion.

* * * * *